US007805106B2

(12) United States Patent
Kikuchi

(10) Patent No.: US 7,805,106 B2
(45) Date of Patent: Sep. 28, 2010

(54) SHEET CUTTING APPARATUS, SHEET PROCESSING APPARATUS, AND IMAGE FORMING APPARATUS

(75) Inventor: Toshiki Kikuchi, Kashiwa (JP)

(73) Assignee: Canon Finetech, Inc., Misato-Shi (JP)

( * ) Notice: Subject to any disclaimer, the term of this patent is extended or adjusted under 35 U.S.C. 154(b) by 1055 days.

(21) Appl. No.: 11/462,184

(22) Filed: Aug. 3, 2006

(65) Prior Publication Data

US 2007/0065203 A1 Mar. 22, 2007

(30) Foreign Application Priority Data

Aug. 10, 2005 (JP) ..... 2005-232341

(51) Int. Cl.
*B26D 7/02* (2006.01)

(52) U.S. Cl. ..... 399/385; 399/407; 83/282

(58) Field of Classification Search ..... 400/621; 399/407, 408, 385
See application file for complete search history.

(56) References Cited

U.S. PATENT DOCUMENTS 7,412,201 B2 * 8/2008 Wakabayashi et al. ..... 399/407
2002/0044852 A1 * 4/2002 Nogawa et al. ..... 412/16
2005/0206064 A1 * 9/2005 Moriyama et al. ..... 270/58.08

FOREIGN PATENT DOCUMENTS

JP 2003-292230 10/2003

* cited by examiner

*Primary Examiner*—Daniel J Colilla
(74) *Attorney, Agent, or Firm*—Fitzpatrick, Cella, Harper & Scinto

(57) ABSTRACT

A sheet cutting apparatus including: an information obtaining device, which obtains information on the thickness of a sheet bundle to be cut; a sheet presser movable between a standby position for receiving the sheet bundle at a predetermined position and a pressing position for pressing the sheet bundle at the predetermined position to fix the sheet bundle; a cutting knife, which cuts the sheet bundle fixed by the sheet presser; and a control device, which moves the sheet presser to another standby position between the standby position and the pressing position before the sheet bundle is conveyed to the predetermined position.

7 Claims, 23 Drawing Sheets

SHEET CUTTING APPARATUS, SHEET PROCESSING APPARATUS, AND IMAGE FORMING APPARATUS

BACKGROUND OF THE INVENTION

1. Field of the Invention

The present invention relates to a sheet cutting apparatus for cutting a sheet bundle to be cut by a cutting device, a sheet processing apparatus, and an image forming apparatus, in particular, a construction for achieving an improvement in productivity.

2. Description of the Related Art

Some conventional image forming apparatuses for forming images on sheets, such as a copying machine, a printer, a facsimile apparatus, and a multi-function apparatus composed of a combination of these apparatuses, are equipped with a sheet processing apparatus for processing a sheet on which an image has been formed by an image forming portion. Some of such sheet processing apparatuses are equipped with a sheet cutting apparatus for cutting a sheet, a sheet bundle, etc. (hereinafter referred to as a sheet bundle to be cut) by a cutting knife, which is an example of a cutting means.

In such a sheet processing apparatus, sheets discharged from the main body of an image forming apparatus are bundled to be subjected to paste bookbinding or saddle stitching folio bookbinding, and the end portions of the sheet bundle are cut by the above-mentioned sheet cutting apparatus so as to align the book end surfaces (see, for example, JP 2003-292230 A). Not only a sheet bundle but also a single sheet may be cut by the sheet cutting apparatus.

In order to cut a sheet bundle to be cut by such a conventional sheet cutting apparatus, the sheet bundle to be cut is first secured in position by a sheet presser means, and then the sheet bundle to be cut is cut by the cutting device. When the sheet bundle to be cut is thus pressed, the sheet presser device starts the operation from the same standby position regardless of the number of sheets of the sheet bundle to be cut or the thickness thereof.

In order to cut a sheet bundle to be cut by such a conventional sheet cutting apparatus, the sheet bundle to be cut is first secured in position by a sheet presser means, and then the sheet bundle to be cut is cut by the cutting device. When the sheet bundle to be cut is thus pressed, the sheet presser device starts the operation from the same standby position regardless of the number of sheets of the sheet bundle to be cut or the thickness thereof.

SUMMARY OF THE INVENTION

The present invention has been made in view of the above problem in the conventional art, and therefore has objects to provide a sheet cutting apparatus, a sheet processing apparatus, and an image forming apparatus capable of achieving an improvement in productivity.

It is an object of the present invention to provide a sheet cutting apparatus, including: information obtaining means for obtaining information on the thickness of a sheet bundle to be cut; a sheet presser movable between a standby position for receiving the sheet bundle at a predetermined position and a pressing position for pressing the sheet bundle at the predetermined position to fix the sheet bundle; a cutting knife, which cuts the sheet bundle fixed by the sheet presser; and control means for moving the sheet presser to another standby position between the standby position and the pressing position before the sheet bundle is conveyed to the predetermined position.

The information obtaining means may obtain the information based on the number of sheets of the sheet bundle and the thickness of the sheet.

The information obtaining means may also have a detector for detecting the thickness of the sheet bundle, and obtain the information based on a detection result of the detector.

It is another object of the present invention to provide a sheet cutting apparatus, including: information obtaining means for obtaining information on the thickness of a sheet bundle to be cut; a sheet presser movable between a first standby position for receiving the sheet bundle at a predetermined position and a pressing position for pressing the sheet bundle at the predetermined position to fix the sheet bundle in position; a cutting knife, which cuts the sheet bundle fixed in position by the sheet presser; and control means for calculating the period of time from the start of the conveyance of the sheet bundle to the activation start of the sheet presser based on the information obtained by the information obtaining means, and for activating the sheet presser at the calculated activation start time such that the sheet presser is positioned at another standby position between the first standby position and the pressing position when the conveyance of the sheet bundle to the predetermined position is completed.

The control means may calculate the moving speed of the sheet presser based on the information obtained by the information obtaining means, and may move the sheet presser from the standby position to the another standby position at the calculated moving speed.

The control means may also move the sheet presser from the another standby position to the pressing position at another moving speed which is higher than the calculated moving speed.

Further features of the present invention will become apparent from the following description of exemplary embodiments with reference to the attached drawings.

DESCRIPTION OF THE EMBODIMENTS

A sheet cutting apparatus according to a preferred embodiment of the present invention, a sheet processing apparatus equipped with this sheet cutting apparatus, and a copying machine, which is an example of an image forming apparatus whose main body is equipped with this sheet processing apparatus as a component, will be described with reference to the drawings. It should be noted that the values given in this embodiment are only given for reference and do not restrict the present invention in any way.

The image forming apparatus is not restricted to a copying machine; it may also be a printer, a facsimile apparatus, or a multi-function apparatus composed of a combination of these apparatuses. The place where the sheet processing apparatus is provided is not restricted to the main body of a copying machine; it may also be provided in the main body of a printer, a facsimile apparatus, or a multi-function apparatus.

Figure 1:
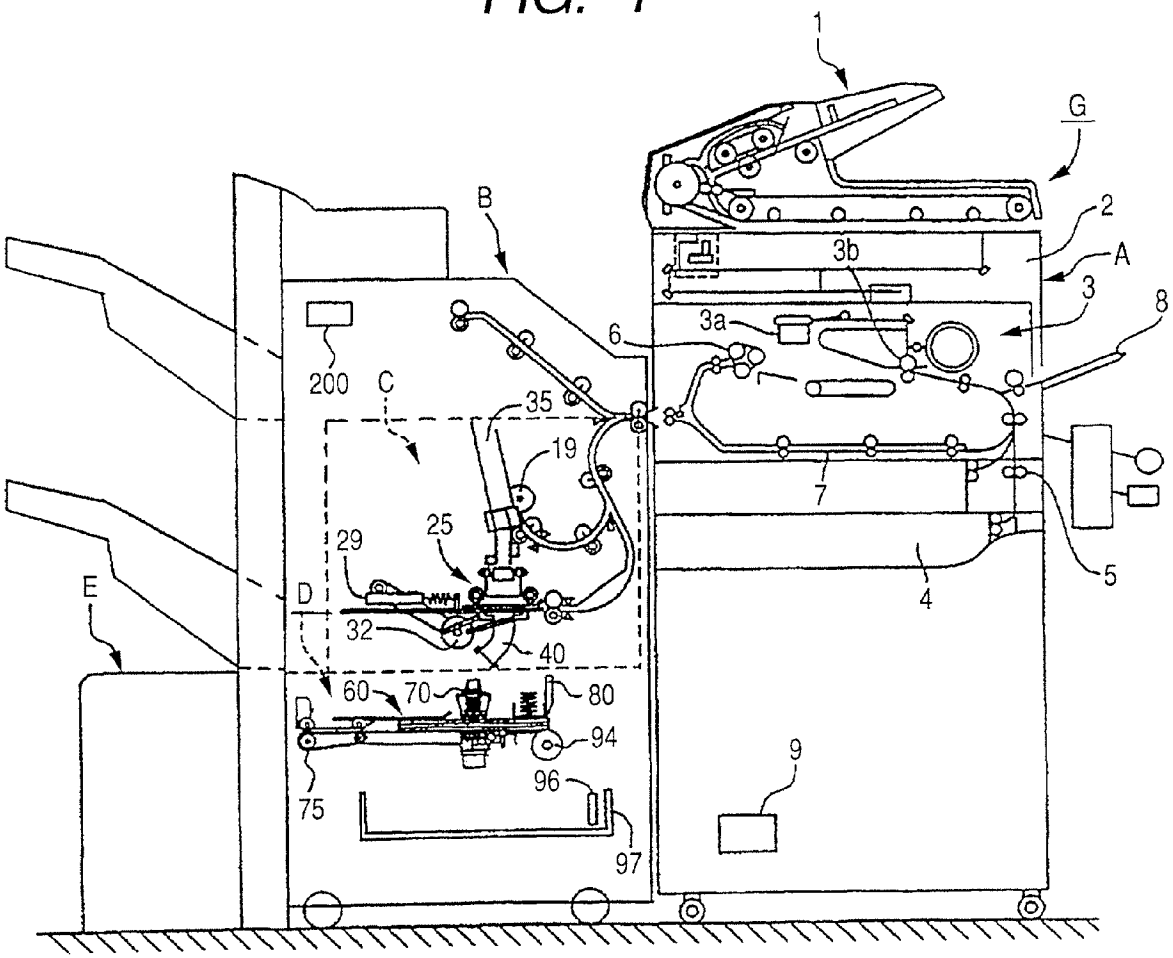
FIG. 1 is a diagram schematically showing the construction of a copying machine, which is an example of an image forming apparatus whose main body is equipped with a sheet processing apparatus having a sheet cutting apparatus according to a first embodiment of the present invention.

FIG. 1 is a diagram schematically showing the construction of a copying machine, which is an example of an image forming apparatus whose main body is equipped with a sheet processing apparatus having a sheet cutting apparatus according to a first embodiment of the present invention. A copying machine G is composed of an apparatus main body A and a sheet processing apparatus B having a trimmer unit D. It is also possible for each of the apparatus main body A and the sheet processing apparatus B to be used singly.

Further, while in FIG. 1 the sheet processing apparatus B is provided beside the apparatus main body A of the copying machine G as a component of the copying machine G, it may also be incorporated in the apparatus main body A. Further, the apparatus main body A of the copying machine G is equipped with a control portion 9 for controlling the apparatus main body A, and the sheet processing apparatus B is provided with a central processing unit (hereinafter, referred to as "CPU") 200 which performs transmission and reception of data, control signals, etc. with the control portion 9 of the apparatus main body A to control the sheet processing apparatus. It is also possible to integrate the control portion 9 and the CPU 200 with each other, and to provide the integral control portion in either the apparatus main body A or the sheet processing apparatus B to control the apparatus main body A and the sheet processing apparatus B.

Further, while, as described below, in the sheet processing apparatus B of this embodiment, the sheets are bundled and then pasted, thus performing bookbinding on the sheet bundle, it is also possible to subject the bundled sheets to saddle stitching folio bookbinding. Further, it is also possible to provide a stapler to perform staple bookbinding.

While the trimmer unit D of this embodiment cuts a sheet bundle that has undergone paste-bookbinding, it may also cut a sheet bundle that has undergone saddle stitching folio bookbinding, or a sheet bundle that has undergone no bookbinding. Further, the trimmer unit D of this embodiment can cut not only a sheet bundle but also a single sheet. That is, the sheet to be cut by the trimmer unit D of this embodiment may be in the form of a sheet, a sheet bundle, or the like. In the following, a case will be described in which a sheet bundle is cut.

Here, the apparatus main body A of the copying machine G optically reads by a scanner portion 2 an original automatically fed from an original feeding apparatus 1, and transmits the information thereof as a digital signal, for example, to an image forming portion 3 serving as an image forming means, thereby performing recording on a sheet such as a plain paper sheet or an OHP sheet.

In a lower portion of the apparatus main body A of the copying machine G, a plurality of sheet cassettes 4 accommodating sheets of various sizes are provided so as to allow drawing out (note that FIG. 1 shows only one of the sheet cassettes). A sheet conveyed from one of the sheet cassettes 4 by conveying rollers 5 undergoes electrophotographic image recording at the image forming portion 3.

When forming an image on a sheet in the apparatus main body A of the copying machine G, constructed as described above, a laser beam is applied to a photosensitive drum 3*b* from a light applying portion 3*a* based on information read by the scanner portion 2 to form a latent image, which is developed with toner and transferred onto the sheet. After that, the sheet to which the toner image has been transferred is conveyed to a fixing portion 6, where it is heated and pressurized, thereby permanently fixing the toner image to the sheet.

In a one-side recording mode, in which a toner image is formed on one surface of a sheet, the apparatus main body A, which has thus formed an image on the sheet, sends the sheet as it is into the sheet processing apparatus B. In a two-side recording mode, in which toner images are formed on both surfaces of a sheet, the sheet, on one surface of which an image has been recorded, is reversed through switch-back conveyance and conveyed to a re-feed path 7, and is conveyed to the image forming portion 3 again to form an image on the other surface before sending the sheet to the sheet processing apparatus B.

Here, before sending the sheet into the sheet processing apparatus B, the control portion 9 of the apparatus main body A transmits a signal indicating sheet size, etc. to the CPU 200 of the sheet processing apparatus B, causing the sheet processing apparatus B to perform beforehand an operation, such as switching of the paths in the sheet processing apparatus B. The sheet can be fed not only through feeding from the sheet cassette 4 but also through manual feeding from a multi-tray 8.

Figure 2:
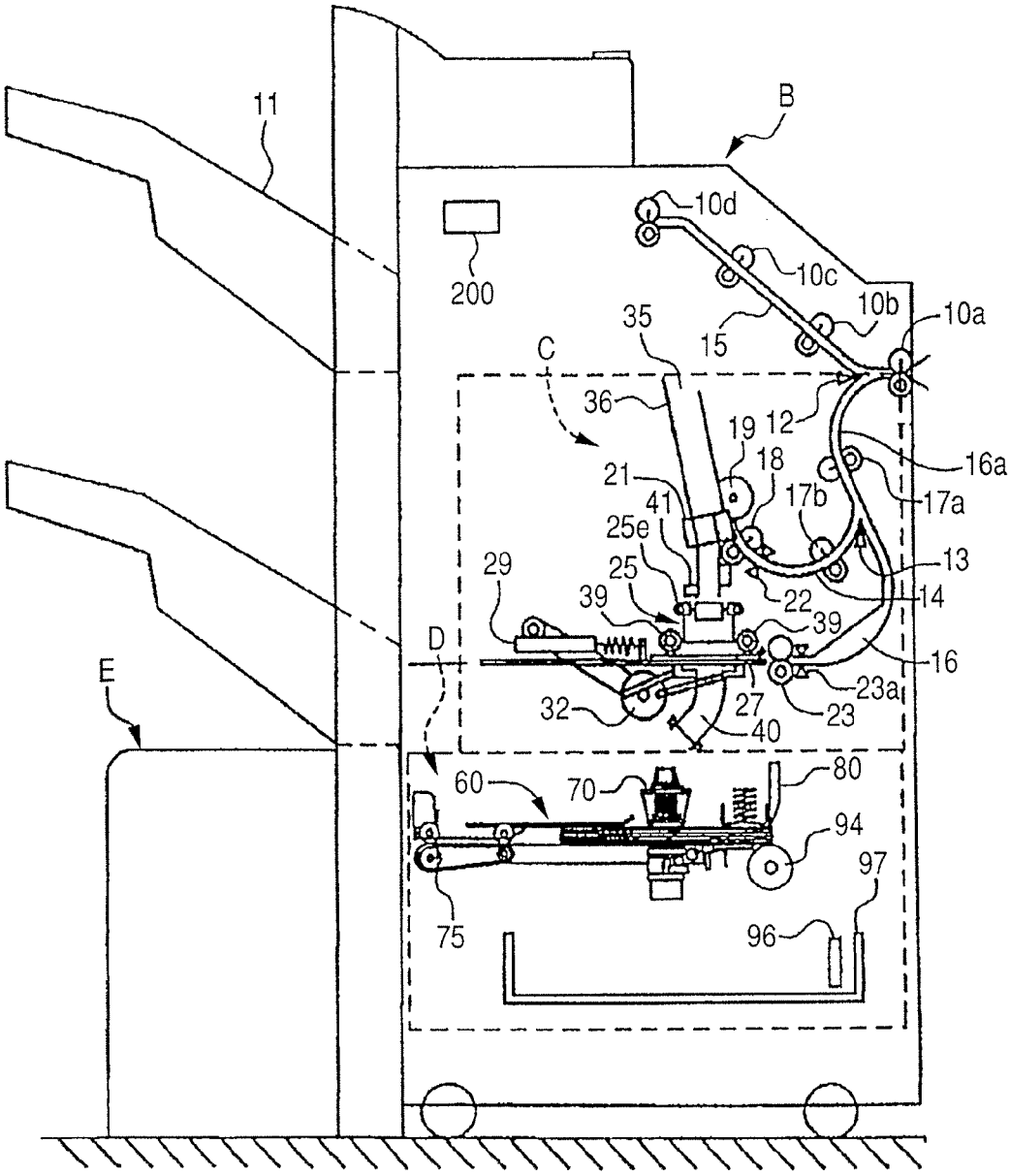
FIG. 2 is a diagram schematically showing the construction of the sheet processing apparatus.

As shown in FIG. 2, the sheet processing apparatus B is composed of a feeding/alignment unit C and the trimmer unit D, and apart from a normal discharge mode, can selectively perform paste-bookbinding and cutting, thereby making it possible to cut the three sides of a sheet bundle other than the pasted side thereof. It is not always necessary for the sheet processing apparatus B to be equipped with the conveyance/alignment unit C; it is also possible for the sheet processing apparatus B to be designed so as to be solely capable of cutting a sheet bundle. Further, it is not always necessary for the trimmer unit D to cut three sides of a sheet bundle; it may cut only one side thereof.

In the normal discharge mode, the sheet discharged into the sheet processing apparatus B from the apparatus main body A of the copying machine G is conveyed to conveying roller pairs 10*a*, 10*b*, 10*c*, and 10*d*, and is discharged onto a stack tray 11. In a paste-bookbinding mode, the sheet is subjected to a predetermined processing described below before being discharged onto a stack tray E.

FIG. 2 shows a non-sorting path 15, a bookbinding path 16*a*, a first flapper 12 for effecting switching between the non-sorting path 15 and the bookbinding path 16*a*, a bookbinding bookblock sheet path 14 through which bookblock sheets to be subjected to bookbinding pass, a cover path 16 through which a cover passes, and a second flapper 13 for effecting switching between the bookbinding bookblock sheet path 14 and the cover path 16.

Figure 3A:
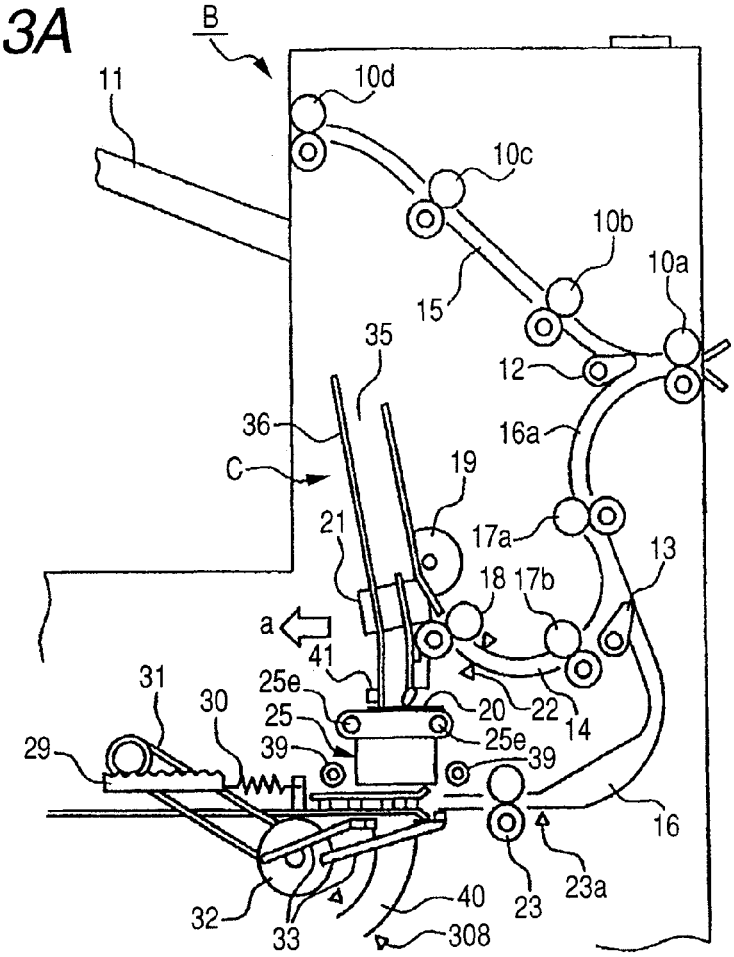
FIGS. 3A and 3B are diagrams illustrating the construction of a conveyance alignment unit of the sheet processing apparatus.
Figure 3B:
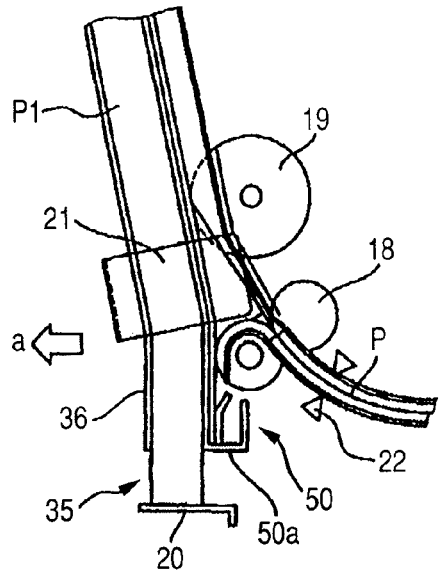

An alignment vertical path 35 constitutes an accommodating means for successively accommodating sheets in an upright state when aligning sheets fed to the bookbinding bookblock sheet path 14. As shown in FIGS. 3A and 3B, the alignment vertical path 35 is equipped with a trailing edge stopper 20 serving as an alignment member provided at the bottom of the alignment vertical path 35, semicircular rollers 19 which are provided on one surface of the alignment vertical path 35 and which constitute an abutment means for returning the sheets P discharged into the alignment vertical path 35 to the trailing edge stopper side and abutting the trailing edges of the sheets P against the trailing edge stopper 20, an alignment plate 21 for pushing in the sheets P in the direction of the sheet center to effect alignment in the width direction, which is a direction perpendicular to the sheet conveying direction, and an alignment vertical path plate 36.

Here, the alignment vertical path plate 36 is provided on the side of the alignment vertical path 35 opposite to the semicircular rollers 19, and serves to retain the sheets P discharged into the alignment vertical path 35 in an upright state and to maintain a substantially fixed contact pressure of the semicircular rollers 19 with respect to the discharged sheets.

In the sheet processing apparatus B having the alignment vertical path 35, constructed as described above, when the bookbinding mode is selected, the sheets P discharged from the apparatus main body A are fed to the bookbinding bookblock sheet path 14 by the switching of the first flapper 12 and the second flapper 13 and by means of the conveying roller pairs 10*a*, 17*a*, and 17*b*, and are further discharged into the alignment vertical path 35 by a discharge roller pair 18.

Next, the sheets P thus discharged into the alignment vertical path 35 are returned to the position where their trailing edges abut the trailing edge stopper 20 by the semicircular rollers 19 and the discharge roller pair 18 to effect alignment (i.e., rear edge alignment) in the sheet conveying direction, and are pushed in the direction of the sheet center by, for example, the alignment plate 21 serving as an alignment means to thereby effect alignment in the direction crossing the sheet conveying direction. That is, the sheets P are pushed in toward the center in the width direction of the sheets (i.e., direction crossing the sheet conveying direction), and the side edges of the sheets are aligned.

The discharge roller pair 18 are controlled such that when the trailing edges of the sheets P pass therethrough, the rotating speed thereof is reduced, whereby the sheets P discharged into the alignment vertical path 35 are reliably drawn into the alignment vertical path 35 through rotation of the semicircular rollers 19, thereby making it possible to reliably effect trailing edge alignment.

In a case where a predetermined period of time has elapsed since the passing of a discharge sensor 22 by the trailing edges of the sheets P, or in a case where the motor has attained a predetermined RPM, it is assumed that the sheets have passed through the discharge roller pair 18.

As shown in FIGS. 3A and 3B, the semicircular rollers 19, which return the sheets P discharged into the alignment vertical path 35 in the direction reverse to the discharge direction, are shaped into a semicircular configuration. Normally, the cutout portions of the semicircular rollers 19 are situated on the alignment vertical path 35 side so that they may not hinder the discharge of the sheets P to be discharged by the discharge roller pair 18.

Each time a sheet P is discharged into the alignment vertical path 35, the semicircular rollers 19 rotate in a direction reverse to the sheet discharging direction of the discharge roller pair 18, and comes into contact with the trailing edge of the sheet P in the alignment vertical path 35, pulling back the sheet P by a frictional force generated between themselves and the sheet P. That is, the semicircular rollers 19 pull back a sheet P in a direction in which it falls.

The semicircular rollers 19 are operated after the discharge roller pair 18 has released the trailing edge of a sheet P. To be more specific, the semicircular rollers 19 rotate in the direction reverse to the sheet discharging direction in the case where a fixed period time has elapsed since the passing, by the trailing edge of the sheet P, of the discharge sensor 22 provided on the upstream side of the discharge roller pair 18.

The alignment vertical path plate 36 can be moved in a direction indicated by the arrow "a" of FIGS. 3A and 3B by an alignment vertical path motor (not shown), thereby making it possible to adjust the path spacing of the alignment vertical path 35. In order to maintain a substantially fixed contact pressure with which the semicircular rollers 19 are held in contact with the uppermost one of the sheets discharged into the alignment vertical path 35, the alignment vertical path 36 moves the alignment vertical path plate 36 so as to widen the path according to the number of sheets discharged into the alignment vertical path 35.

For example, when the number of sheets P accommodated in the alignment vertical path 35 is small, the alignment vertical path plate 36 is moved so as to diminish the path spacing, whereby it is possible to prevent buckling of the sheets P, and to maintain a substantially fixed contact pressure with which the semicircular rollers 19 are held in contact with the sheets 19 discharged into the alignment vertical path 35, thus making it possible to prevent defective sheet return.

When the number of sheets accommodated increases, the alignment vertical path plate 36 is moved so as to widen the path spacing of the alignment vertical path 35, whereby it is possible to reliably return the sheets P even when the thickness of the sheet bundle is increased, thus making it possible to prevent defective sheet return.

The alignment vertical path plate 36 can be reciprocated in the direction indicated by the arrow "a" by a rack (not shown) formed on a part of the alignment vertical path plate 36 and the alignment vertical path motor (not shown), whereby it is possible to adjust the distance between the alignment vertical path plate 36 and the semicircular rollers 19 (i.e., spacing of the alignment vertical path 35).

When the sheets P are successively conveyed to the alignment vertical path 35, the sheets P are pulled back by the semicircular rollers 19, and the sheets are stacked in the alignment vertical path 35 until a predetermined target number of sheets is attained. In a process in which the sheets P are stacked and aligned in the alignment vertical path 35 for the preparation of a first book and then the operation such as pasting is performed, the bundle of sheets P results in continuing to exist in the alignment vertical path 35.

Thus, it is impossible to convey the subsequent sheets P for the preparation of a second book from the apparatus main body A, and the conveyance of the sheets P is suspended until the operation such as pasting for the first book is completed and the sheet bundle P1 is discharged from the alignment vertical path 35, resulting in a rather low productivity.

In view of this, in this embodiment, there is provided, in close proximity to the alignment vertical path 35, a buffer mechanism 50 that temporarily keeps on standby the subsequent sheets P conveyed from the apparatus main body A for the preparation of a second book until the operation such as pasting on the sheet bundle P1 for the first book is completed and the sheet bundle P1 is discharged from the alignment vertical path 35.

Figure 4:
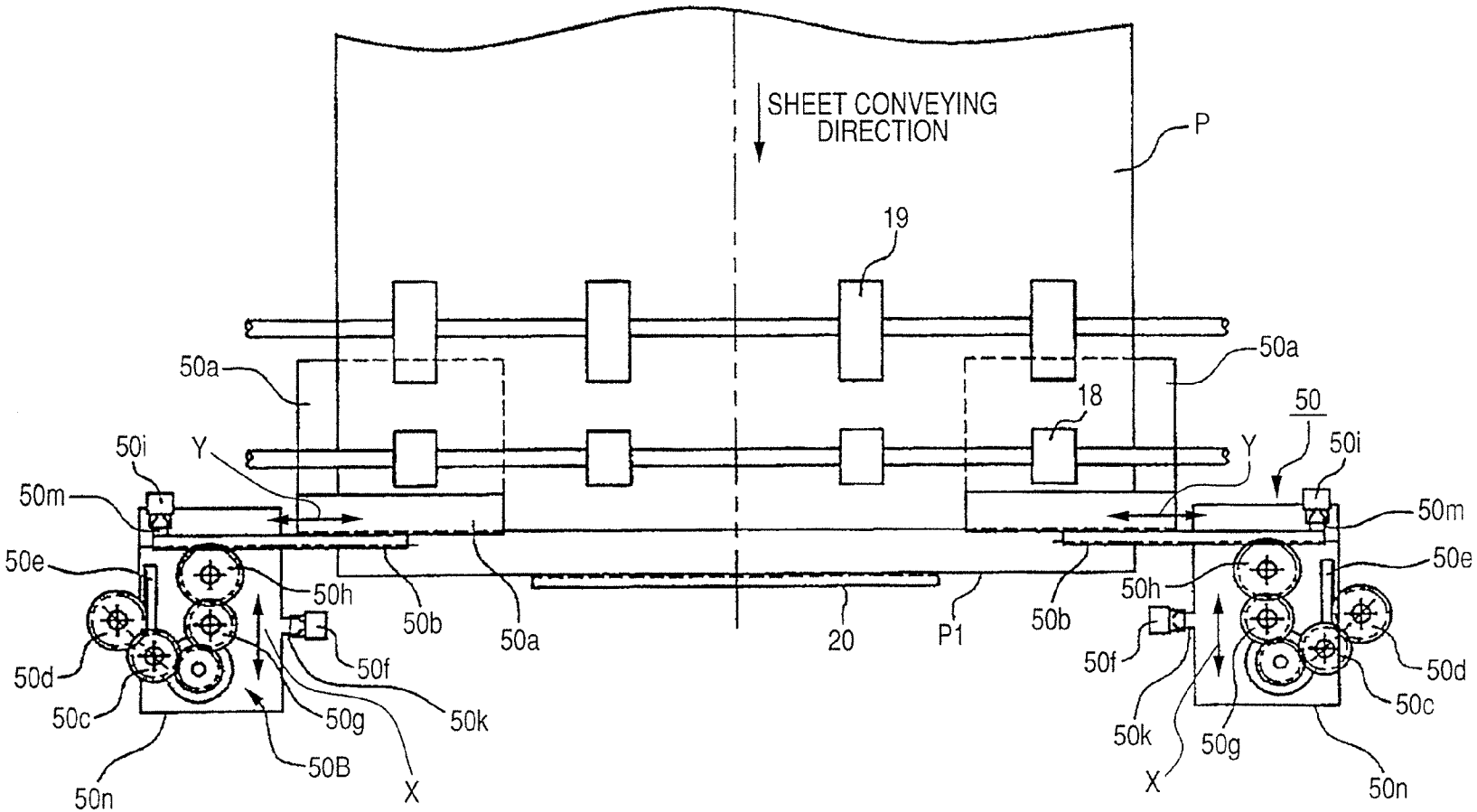
FIG. 4 is a side view of a buffer mechanism provided in the conveyance alignment unit.

Here, as shown in FIGS. 3B and 4, the buffer mechanism 50 is equipped with receiving pads 50*a* for retaining the sheets P, and a drive portion 50B which moves the receiving pads 50*a* in a direction X, which is the same as the sheet conveying direction, and a width direction Y, which is a direction perpendicular to (crossing) the sheet conveying direction, by a motor (not shown) and electromagnetic clutch gears 50*c* and 50*g*. It should be noted that in FIG. 4, the discharge roller pair 18, the semicircular rollers 19, racks 50*e*, and photo sensors 50*f* do not move.

When moving the receiving pads 50*a*, for example, in the direction X, which is the same as the sheet conveying direction, the drive portion 50B places solely the clutch gears 50*c* in a torque transmission state so that the rotation of the motor (not shown) is transmitted to the gears 50*d*. As a result, the gears 50*d* rotate on the stationary racks 50*e*, and the various portions of the buffer mechanism 50 except for the racks 50*e* move integrally in the direction X, which is the same as the sheet conveying direction.

That is, the receiving pads 50*a* move in the direction X, which is the same as the sheet conveying direction. At this time, the photo sensors 50*f*, and protrusions 50*k* on moving members 50*n* shading the photo sensors 50*f*, perform detection of the moving position in the direction X, which is the same as the conveying direction of the buffer mechanism 50 except for the racks 50*e*, and movement control based on the position detected.

To move the receiving pads 50*a* in the width direction Y, solely the electromagnetic gears 50*g* are placed in a torque transmission state so that the rotation of the motor is transmitted to the gears 50*h*, thereby moving racks 50*b*. As a result, the receiving pads 50*a* move in the direction perpendicular to the sheet conveying direction.

At this time, photo sensors 50*i* provided on the moving members 50*n*, and protrusions 50*m* provided at one end of each rack 50*b* shading the photo sensors 50*i*, perform detection of the moving position of the receiving pads 50*a* in the direction Y perpendicular to the sheet conveying direction, and movement control based on the position detected. Except when buffering the sheets P, the receiving pads 50*a* of the buffer mechanism 50 are retracted to home positions on the outer sides of the widths of the sheets P shown in FIG. 4, so the receiving pads 50*a* do not hinder the conveyance of the sheets.

Next, the basic operation of the buffer mechanism 50, constructed as described above, will be illustrated.

When, as shown in FIG. 3B, the sheet bundle P1 is stacked and aligned on the trailing edge stopper 20 and exists in the alignment vertical path 35, and has not been discharged from the alignment vertical path 35 yet, the buffer mechanism 50 causes the receiving pads 50*a* to slide from the home positions, where the conveyance of the sheets P is not hindered, to the positions where the sheets P are received, by the rotation of the gear 50*h* shown in FIG. 4 and the racks 50*b* to buffer the sheets P successively conveyed from the apparatus main body A.

When the sheet bundle P1 is discharged from the alignment vertical path 35 and ceases to exist on the trailing edge stopper 20, the buffer mechanism 50 causes the receiving pads 50*a* to move toward the trailing edge stopper 20 on the downstream side with respect to the sheet conveying direction. As a result, the trailing edges of the buffered sheets P are supported by the trailing edge stopper 20, and when the trailing edges of the sheets P are thus supported, the movement of the receiving pads 50*a* is stopped, and the receiving pads 50*a* are retracted to the home positions.

Here, when the receiving pads 50*a* thus move to the retracted positions, the sheets P move into the alignment vertical path 35 due to their own weight. Finally, the receiving pads 50*a* are returned in the direction opposite to the trailing edge stopper 20, and moved to the initial, retracted positions (home positions) to thereby end the operation. This operation is repeated until the bookbinding of the target number of sheet bundles is completed.

Next, the conveyance of a cover will be illustrated.

A sheet P2 (hereinafter, referred to as "cover sheet") discharged from the apparatus main body A and constituting a cover is guided to a cover path 16 by the first flapper 12 and the second flapper 13. As shown in FIG. 2 (see FIG. 3A), halfway through the cover path 16, there are arranged a registration roller pair 23 and a registration leading edge sensor 23*a* on the upstream side of the registration roller pair 23.

Here, the registration roller pair 23, which is at rest when the cover sheet P2 is guided to the cover path 16, starts to rotate after a fixed period of time since the abutment of the leading edge of the cover sheet P2 against the registration roller pair 23. A judgment as to whether the leading edge of the cover sheet P2 has abutted the registration roller pair 23 or not is made by checking whether a predetermined period of time has elapsed since the passing of the registration leading edge sensor 23*a* by the cover sheet P2 or by detecting the RPM of the motor.

Through this control, in which the registration roller pair 23 are thus kept at rest, a loop is formed at the leading edge of the cover sheet P2 guided to the cover path 16, thereby effecting skew feed correction.

Figure 5:
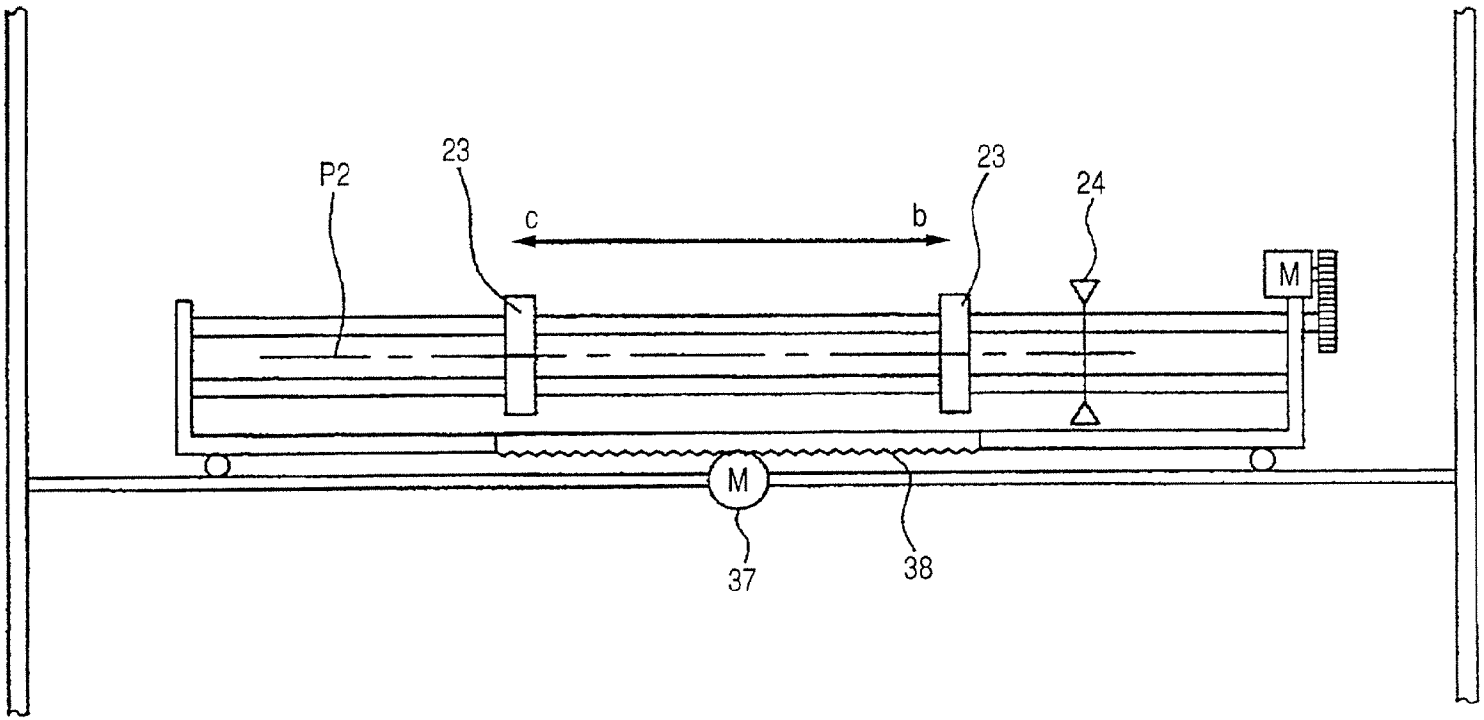
FIG. 5 is a diagram illustrating a registration roller pair provided in the buffer mechanism.

As shown in FIG. 5, the registration roller pair 23 can be moved in the sheet width direction by a pinion gear (not shown) rotated by a cover motor 37 and by a rack 38. After the trailing edge of the cover sheet P2 leaves the conveying roller pair 17*a*, the registration roller pair 23 move in the direction indicated by the arrow "b" of FIG. 5 while nipping and conveying the cover sheet P2. Further, after a registration sensor 24 is shaded by the cover sheet P2 through this movement, the conveying roller pair 17*a* move in the direction indicated by the arrow "c" to cancel the shading of the registration sensor 24, and then move by a fixed amount before stopping.

Here, the registration sensor 24 is arranged at a sheet end position (side end position) of the sheet bundle P1 in the alignment vertical path 35, so the cover sheet P2 in the cover sheet path 16 and the sheet bundle P1 in the alignment vertical path 35 move to positions deviated by a fixed amount in the width direction of the sheet and the sheet bundle. After that, the registration roller pair 23 receive a sheet size signal from the apparatus main body A, and convey the cover sheet P2 in the cover sheet path 16 by a prescribed amount according to the sheet size before stopping.

After the cover sheet P2 is thus moved, the sheet bundle P1 stacked in the alignment vertical path 35 is guided to the cover sheet side by a gripper 41 situated in the lower portion of the alignment vertical path 35 as shown in FIGS. 3A, 6A, 6B, 6C, and 6D, and the trailing edge of the sheet bundle P1 is superimposed on the central portion of the cover sheet P2. After that, a paste bookbinding operation is conducted by a pasting unit 25.

Figure 7:
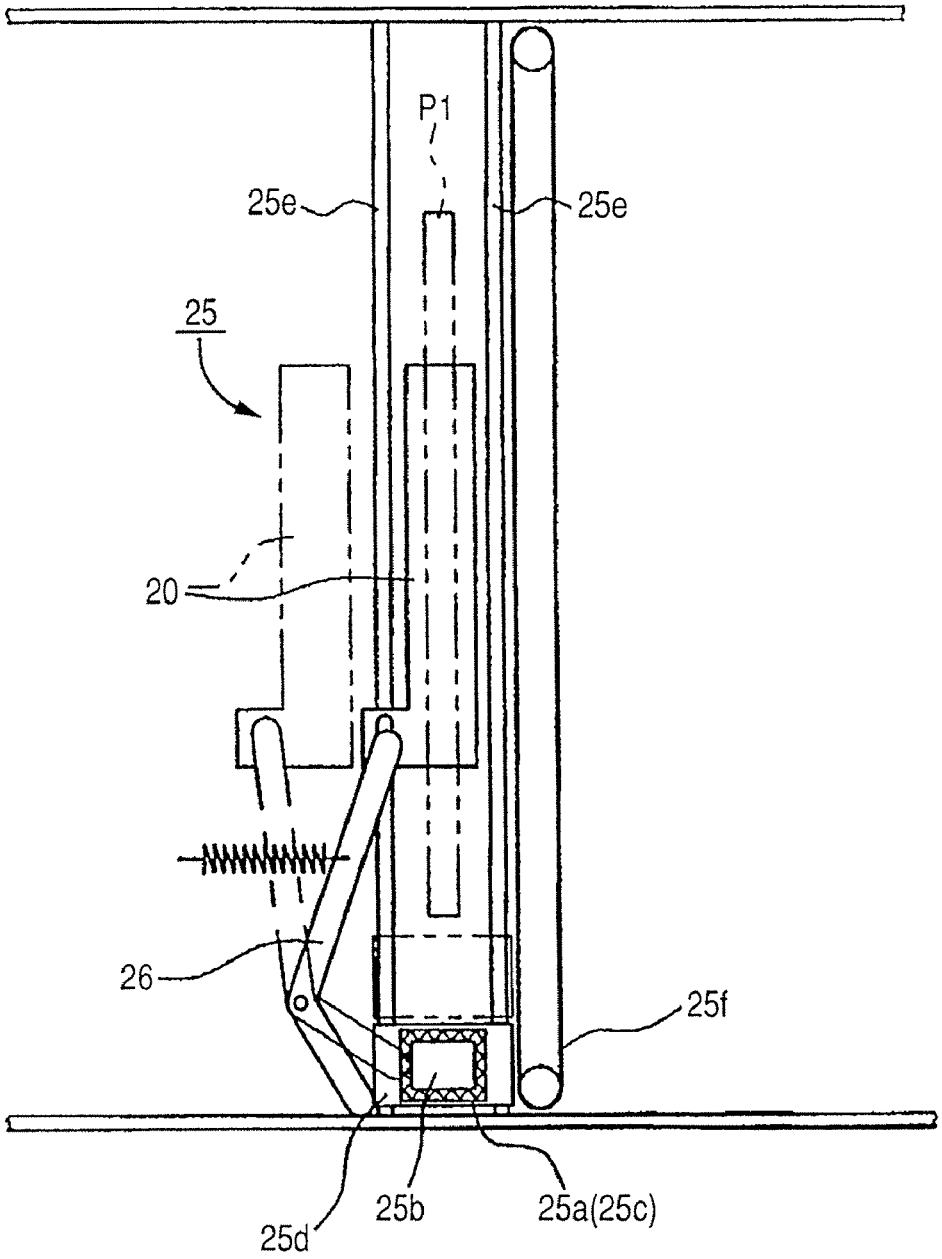
FIG. 7 is a diagram schematically showing the construction of a pasting unit provided in the sheet processing apparatus.

Here, as shown in FIG. 7, the pasting unit 25 is composed of a tub 25*a*, a paste roller 25*b*, paste 25*c*, a tub heater 25*d*, a shaft 25*e*, and a tub driving device 25*f*. The tub 25*a* is adapted to be moved along the shaft 25*e* by the tub driving device 25*f* beyond the sheet width in the sheet width direction, which is perpendicular to the sheet conveying direction. Two positions beyond the sheet width (the upper edge side and the lower edge side in the drawing) constitute the retracted positions for the tub.

As the tub 25*a* moves from the first retracted position to the second retracted position, a part of the tub 25*a* pushes a part of a link 26 engaged with the trailing edge stopper 20, causing the trailing edge stopper 20 to move so as to retract from the lower portion of the sheet bundle P1 of FIG. 3B. The paste roller 25*b* is mounted to the tub 25*a*, and is adapted to rotate as the tub 25*a* moves.

The tub heater 25*d* is mounted to the outer side of the tub 25*a*. When the bookbinding mode is started, the tub heater 25*d* heats the tub 25*a* to melt the paste 25*c* in the tub 25*a*. Through the movement of the tub 25*a* by the tub driving device 25*f*, the paste roller 25*b* rotates, and the molten paste is spread all over the outer peripheral surface of the paste roller 25*b*.

Then, the sheet bundle P1 stacked in the alignment vertical path 35 is retained by the gripper 41 (see FIG. 3A), and the tub 25*a* moves from the first retracted position to the second retracted position to cause the trailing edge stopper 20 to retract from the lower portion of the sheet bundle P1, whereby the paste 25*c* is applied to the lower end surface of the sheet bundle P1 by the pasting unit 25.

Next, the bookbinding process will be described with reference to FIGS. 6A, 6B, 6C, and 6D.

Figure 6A:
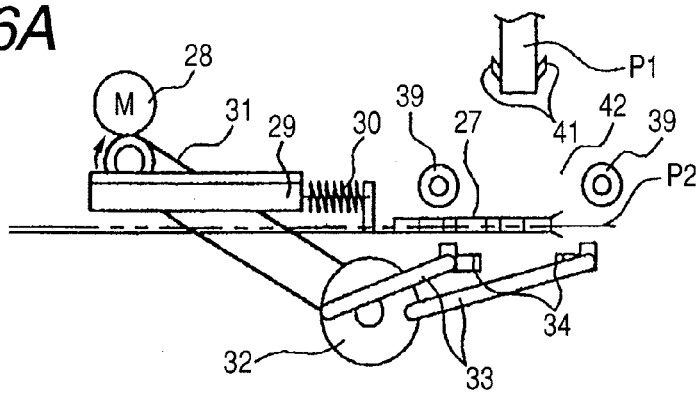
FIGS. 6A, 6B, 6C, and 6D are diagrams illustrating a bookbinding process for bonding a cover sheet to a pasted sheet bundle in the sheet processing apparatus.

In FIGS. 6A through 6D, a shutter 27 is situated on the downstream side of the cover path 16 as shown in FIG. 2. When the bookbinding process is started, and the cover sheet P2 is being conveyed as shown in FIG. 6A, a cover attachment path 42 is kept closed.

Figure 6B:
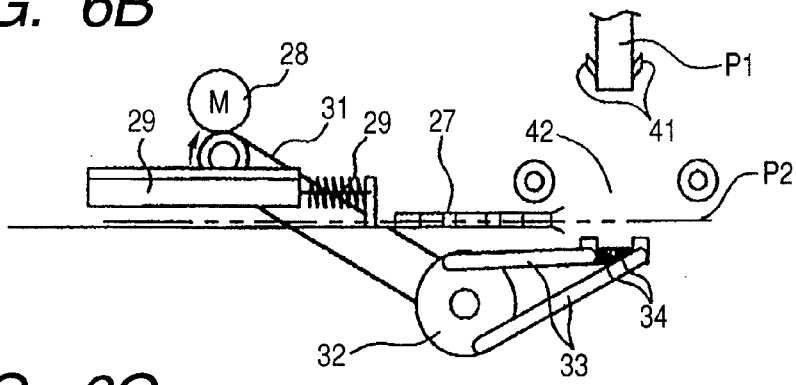

As shown in FIG. 6B, during the bookbinding process, a shutter motor 28 drives a shutter rack 29, and moves the shutter 27 and a spring 30 pulling the shutter rack 29 in one direction to a position where they open the cover attachment path 42. After opening the cover attachment path 42, the shutter 27 abuts a stopper (not shown), and then stops.

The paste 25*c* is applied to the sheet bundle P1 retained by the gripper 41 by the pasting unit 25 shown in FIG. 7. After that, the gripper 41 moves the sheet bundle P1 that has undergone pasting so as to bring it into press contact with the cover sheet P2 on creasing stages 34, and brings the sheet bundle P1 into press contact with the cover sheet P2.

Figure 6C:
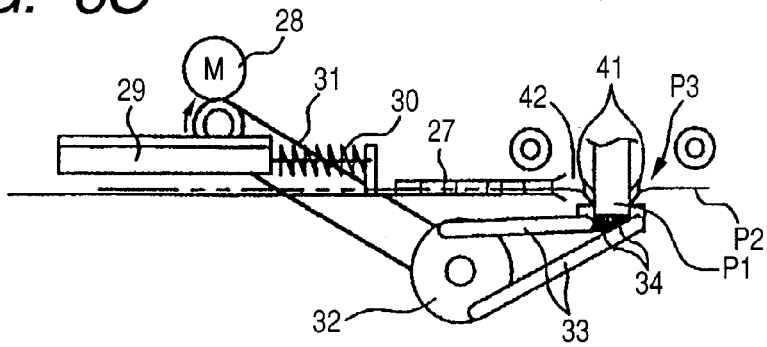

Next, as shown in FIG. 6C, when the shutter motor 28 is further driven, a cam 32 adapted to be rotated by the shutter motor 28 through a belt 31 further rotates to bring the creasing stages 34 close to each other by guide shafts 33. The creasing stages 34 perform creasing for a fixed period of time, whereby a bookbinding sheet bundle P3 is completed.

Figure 6D:
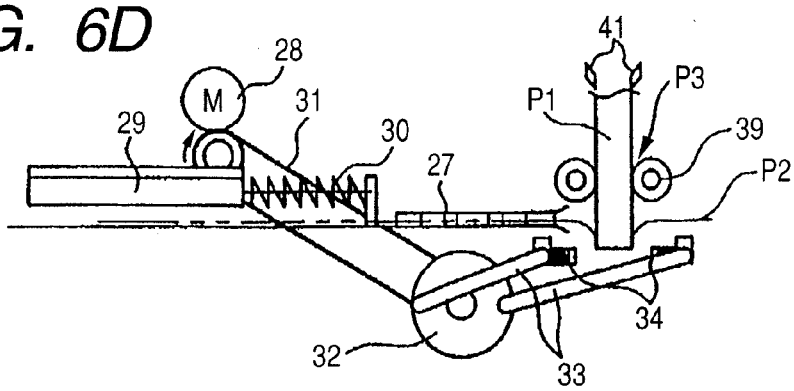

The creasing stages 34 are provided with an escape mechanism so as to be compatible with a change in sheet thickness. As shown in FIG. 6D, by causing the cam 32 to further continue to rotate, the creasing stages 34 are spaced apart and retracted from each other. As a result, the bookbinding sheet bundle P3 is pushed out downstream by push-out rollers 39, and conveyed to a bundle curvature path 40 (see FIG. 2), and is conveyed to a rotary stage through the bundle curvature path 40.

Here, the rotary stage 60 rotates the bookbinding sheet bundle P3 that has undergone bookbinding, and conveys the bookbinding sheet bundle P3 into the trimmer unit D. Next, the rotary stage 60 will be described with reference to FIGS. 8A, 8B, and 8C.

Figure 8A:
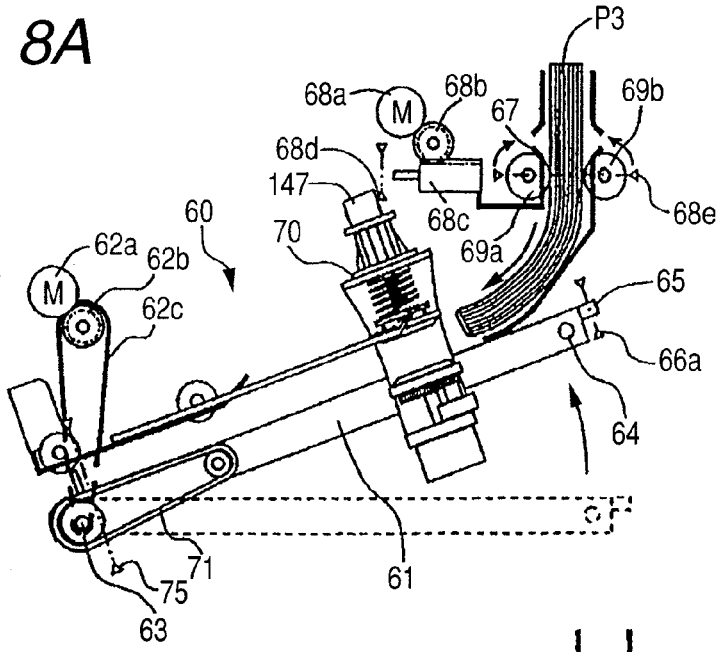
FIGS. 8A, 8B, and 8C are diagrams illustrating the operation of a rotary stage of the sheet processing apparatus.

As shown in FIG. 8A, a rocking unit 61 provided in the rotary stage 60 is constructed such that rotation of a rocking motor 62*a* is transmitted to a rocking drive step gear (not shown) through a rocking ascent/descent gear 62*b* and a rocking ascent/descent belt 62*c*, and is further transmitted to a link mechanism (not shown), using a rotation shaft 63 as a rotation center, by a rocking drive belt (not shown) stretched between the rotation shaft 63 and a link shaft 64, whereby the right-hand side of the rocking unit 61 is raised.

The rise of the rocking unit 61 is detected through detection of a protrusion 65 of the rocking unit 61 by a rock lift detecting sensor 66*a*. Then, upon receiving a signal indicating the detection of the protrusion 65 from the rock lift detecting sensor 66*a*, the CPU 200 stops the rocking motor 62*a*, whereby the rocking unit 61 is kept on standby at the position shown in FIG. 8A.

Above the rocking unit 61, there is arranged an entrance guide 67 for receiving the bookbinding sheet bundle P3, and the entrance guide 67 is equipped with an entrance driven roller 69*a* and is adapted to be moved in the thickness direction of the bookbinding sheet bundle P3 by an entrance guide motor 68*a*. Here, the entrance guide motor 68*a* is started through control by the CPU 200, and rotates an entrance guide gear 68*b* to cause an entrance rack 68*c* connected to the entrance guide 67 to move, thereby moving the entrance guide 67 in such a direction as to receive the bookbinding sheet bundle P3.

After moving the entrance guide 67, the entrance guide motor 68*a* further continues to rotate, and when an entrance guide open/close sensor 68*d* detects the entrance rack 68*c*, the entrance guide motor 68*a* stops rotation through control by the CPU 200, and stops the movement of the entrance guide 67. In this state, the entrance guide 67 is kept on standby.

When the bookbinding sheet bundle P3 that has undergone bookbinding in the bookbinding process is sent into the entrance guide 67 from the conveyance alignment unit C, and the leading edge of the bookbinding sheet bundle P3 is detected by an entrance sensor 68*e*, the CPU 200 rotates the entrance guide motor 68*a* based on the detection signal of the entrance sensor 68*e*, and brings the entrance guide 67 close to the bookbinding sheet bundle P3, pressing the entrance driven roller 69*a* against the bookbinding sheet bundle P3 and nipping the bookbinding sheet bundle P3 together with a bundle conveying roller 69*b*. After that, when the bundle conveying roller 69*b* rotates in the direction indicated by the arrow of FIG. 8A, the bookbinding sheet bundle P3 is sent into the rotary stage 60.

After conveying the bookbinding sheet bundle P3 by a fixed amount, the bundle conveying roller 69*b* stops the conveyance of the bookbinding sheet bundle P3 while nipping the bookbinding sheet bundle P3 together with the entrance driven roller 69*a* of the entrance guide 67.

The bookbinding sheet bundle P3 thus sent into the rotary stage 60 by the bundle conveying roller 69*b* is nipped by a gripper unit 70, and is conveyed to a sheet discharge belt 71. By thus being conveyed while nipped by the gripper unit 70, the bookbinding sheet bundle P3 reliably reaches the sheet discharge belt 71.

Figure 8B:
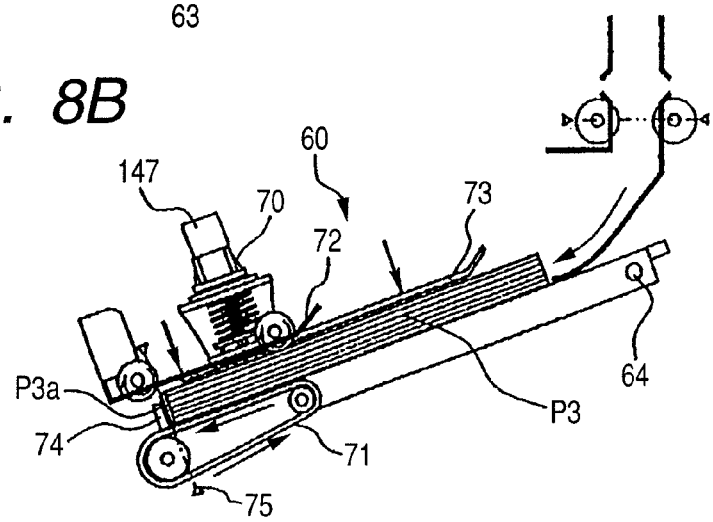
Figure 8C:
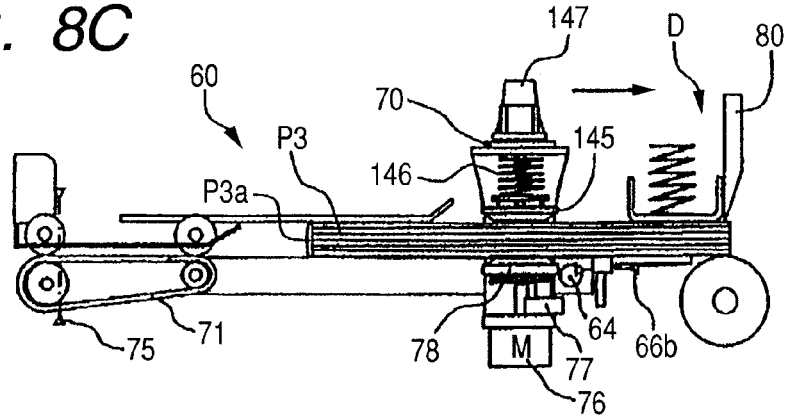
Figure 9:
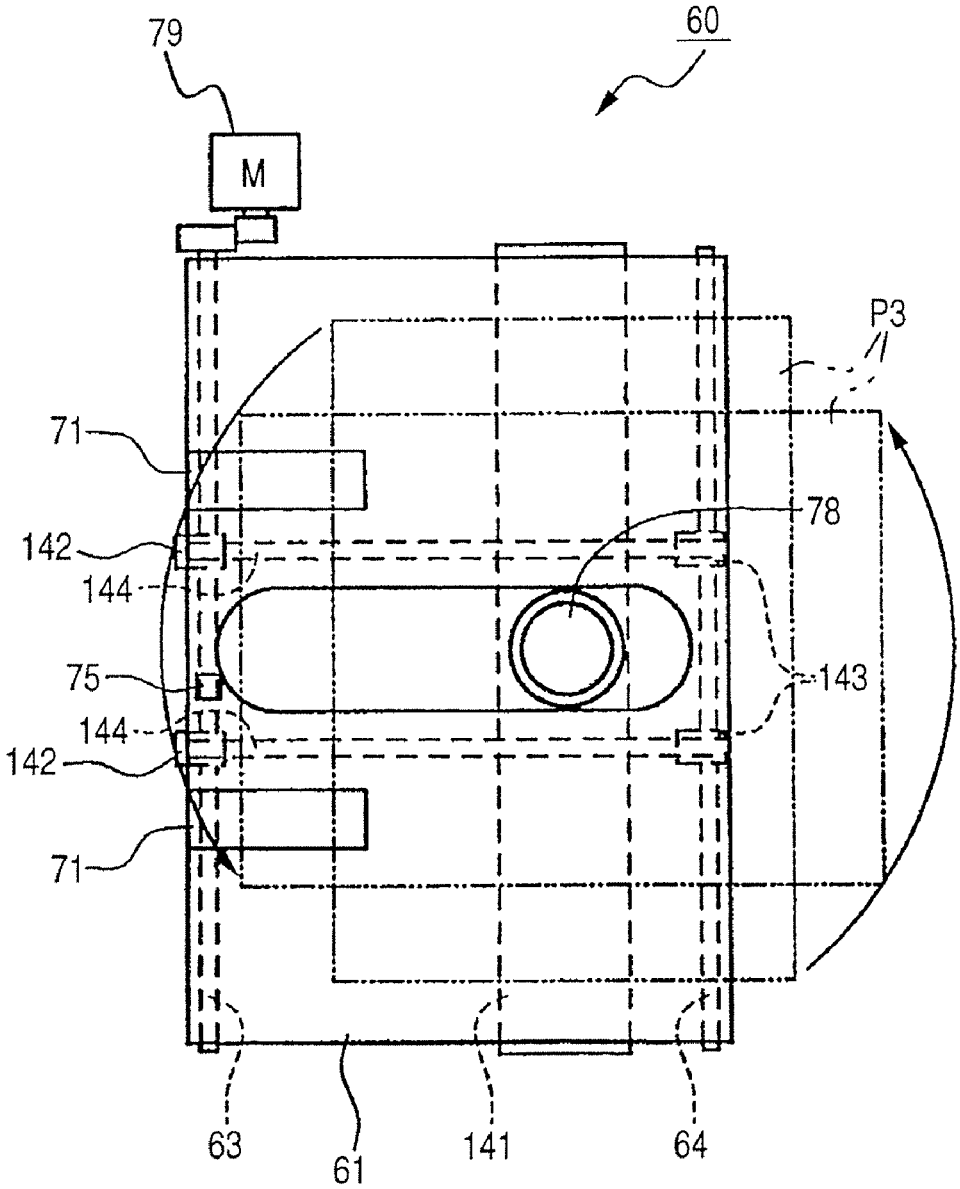
FIG. 9 is a plan view of the rotary stage.

Here, the gripper unit 70 is provided on a support plate 141 shown in FIG. 9, and the support plate 141 is provided on a pair of belts 144 stretched between a pair of pulleys 142 and 143. The pulley 142 is rotated by a horizontal movement motor 79, whereby the gripper unit 70 is moved to the right and left of FIGS. 8A through 8C and FIG. 9 by the horizontal movement motor 79.

Further, as shown in FIG. 8C, the gripper unit 70 has a nipping member 145 for nipping the bookbinding sheet bundle P3 together with a rotation guide gear 78. The nipping member 145 is urged toward the rotation guide gear 78 by a spring 146, and is adapted to be separated from the rotation guide gear 78 against the force of the spring 146 by a rotation of a nip release motor 147.

Then, after being conveyed to the sheet discharge belt 71 by the gripper unit 70, constructed as described above, the bookbinding sheet bundle P3 is pressed in the direction indicated by the arrow of FIG. 8B by a face presser unit 72 capable of being moved toward and away from the bookbinding sheet bundle by a motor (not shown), and is also pressed by an air releasing unit 73 capable of being moved toward and away from the bookbinding sheet bundle by the motor of the face presser unit 72.

Next, after the face pressing operation and the air releasing operation have been thus performed on the bookbinding sheet bundle P3, the CPU 200 (see FIG. 13) releases the nip of the bookbinding sheet bundle P3 by the gripper unit 70, and the sheet discharge belt 71 is caused to run in the direction indicated by the arrows of FIG. 8B, causing the pasted end portion P3*a* of the bookbinding sheet bundle P3 to abut a registration plate 74, which is vertically movable, to perform registration operation on the bookbinding sheet bundle P3. That is, skew feed of the bookbinding sheet bundle P3 is corrected to be straight.

At the same time, when the sheet discharge sensor 75 detects the pasted end portion P3*a* of the bookbinding sheet bundle P3, the CPU 200 causes the sheet discharge belt 71 to run for a predetermined period of time based on the detection signal, and then stops the running. After that, the CPU 200 moves the gripper unit 70 to the rotation center position of the bookbinding sheet bundle P3 and stops the gripper unit 70 there, causing the gripper unit 70 to nip the bookbinding sheet bundle P3 again.

After the gripper unit 70 nips the bookbinding sheet bundle P3, the rocking motor 62*a* shown in FIG. 8A starts, and the torque of the rocking motor 62*a* is transmitted to the rocking drive step gear (not shown) through the rock ascent/descent gear 62*b* and the rock ascent/descent belt 62*c*. Further, the torque of the rocking motor 62*a* is transmitted to the link mechanism (not shown), using the rotation shaft 63 as the rotation center, through the rocking drive belt (not shown) stretched between the rotation shaft 63 and the link shaft 64, whereby the right-hand side of the rocking unit 61 is lowered as shown in FIG. 8C.

It is also possible for the right-hand side of the rocking unit 61 to be lowered after the trailing edge of the bookbinding sheet bundle P3 is detected by a sensor 308 shown in FIG. 3A.

The lowering of the rocking unit 61 is detected through detection of the protrusion 65 of the rocking unit 61 by the horizontal sensor 66*b*, and upon receiving a signal indicating the detection of the protrusion 65 from the horizontal sensor 66*b*, the CPU 200 stops the rocking motor 62*a*. As a result, the rocking unit 61 is kept on standby at the position shown in FIG. 8C.

After that, as shown in FIG. 8C, the gripper unit 70 nips the bookbinding sheet bundle P3 and is moved in the direction indicated by the arrow by the horizontal movement motor 79 (see FIG. 9), whereby the bookbinding sheet bundle P3 is conveyed to a predetermined position in the trimmer unit D and is cut there. An end portion of the bookbinding sheet bundle P3 that is cut at this time is an end portion parallel to the pasted end portion P3*a*.

Next, after the bookbinding sheet bundle P is thus cut by the trimmer unit D, the gripper unit 70 moves to a predetermined rotating position integrally with the support plate 141 shown in FIG. 9 while nipping the bookbinding sheet bundle P3. Then, the gripper unit 70, which has reached the rotating position, receives the torque of a rotating motor 76 shown in FIG. 8C through a rotation gear 77 and a rotation guide gear 78 and rotates by 90 degrees in the direction indicated by the arrow of FIG. 9 together with the support plate 141, causing the bookbinding sheet bundle P3 to rotate by 90 degrees.

Next, to grasp the relationship between the position where the bookbinding sheet bundle P3 is nipped and the next cutting position, the gripper unit 70, which has rotated the bookbinding sheet bundle P3 by 90 degrees, temporarily moves the bookbinding sheet bundle P3 away from the trimmer unit D, and causes the end portion of the bookbinding sheet bundle P3 to be detected by a sheet discharge sensor 75.

When the sheet discharge sensor 75 detects the end portion of the bookbinding sheet bundle P3, the gripper unit 70 conveys the bookbinding sheet bundle P3 into the trimmer unit D again, and the trimmer unit D cuts the end portion of the conveyed bookbinding sheet bundle P3 again. The end portion that is cut by the trimmer unit at this time is an end portion perpendicular to the pasted end portion P3*a*.

After the completion of the cutting, the gripper unit 70 conveys the bookbinding sheet bundle P3 to the predetermined rotating position again, and rotates the bookbinding sheet bundle P3 by 180 degrees this time by the same operation and in the same rotating direction as in the above-mentioned rotating operation. Since the gripper unit 70 has grasped the positional relationship between the nipping position for the bookbinding sheet bundle P3 and the end portion of the bookbinding sheet bundle P3 in the previous cutting, the gripper unit 70 causes the bookbinding sheet bundle P3 to rotate by 180 degrees without causing the end portion of the bookbinding sheet bundle P3 to be detected by the sheet discharge sensor 75, and then conveys the bookbinding sheet bundle P3 to the cutting position again.

Then, the trimmer unit D cuts the end portion of the conveyed bookbinding sheet bundle P3 again. At this time, the end portion that is cut by the trimmer unit is the remaining end portion perpendicular to the pasted end portion P3*a*.

After that, the bookbinding sheet bundle P3 thus cut on three sides is rotated by 90 degrees again by the gripper unit 70 through the same operation, and is conveyed to the position where the pasted end portion P3*a* of the bookbinding sheet bundle P3 is detected by the sheet discharge sensor 75.

When the pasted end portion P3*a* of the bookbinding sheet bundle P3 is detected by the sheet discharge sensor 75, the gripper unit 70 releases the nip of the bookbinding sheet bundle P3, and the face presser unit 72 pressurizes the bookbinding sheet bundle P3. After that, the sheet discharge belt 71 runs counterclockwise as seen in FIG. 8C to discharge the bookbinding sheet bundle P3 onto the stack tray E.

Next, the trimmer unit D will be described.

The trimmer unit D cuts the bookbinding sheet bundle P3 conveyed from the rotary stage 60. The rotary stage 60 is an example of the sheet conveying device for conveying the bookbinding sheet bundle P3 to a position where it is pressed by a sheet presser 93 to be described below. The construction composed of the rotary stage 60, the trimmer unit D, etc. is an example of the sheet cutting apparatus.

Figure 10:
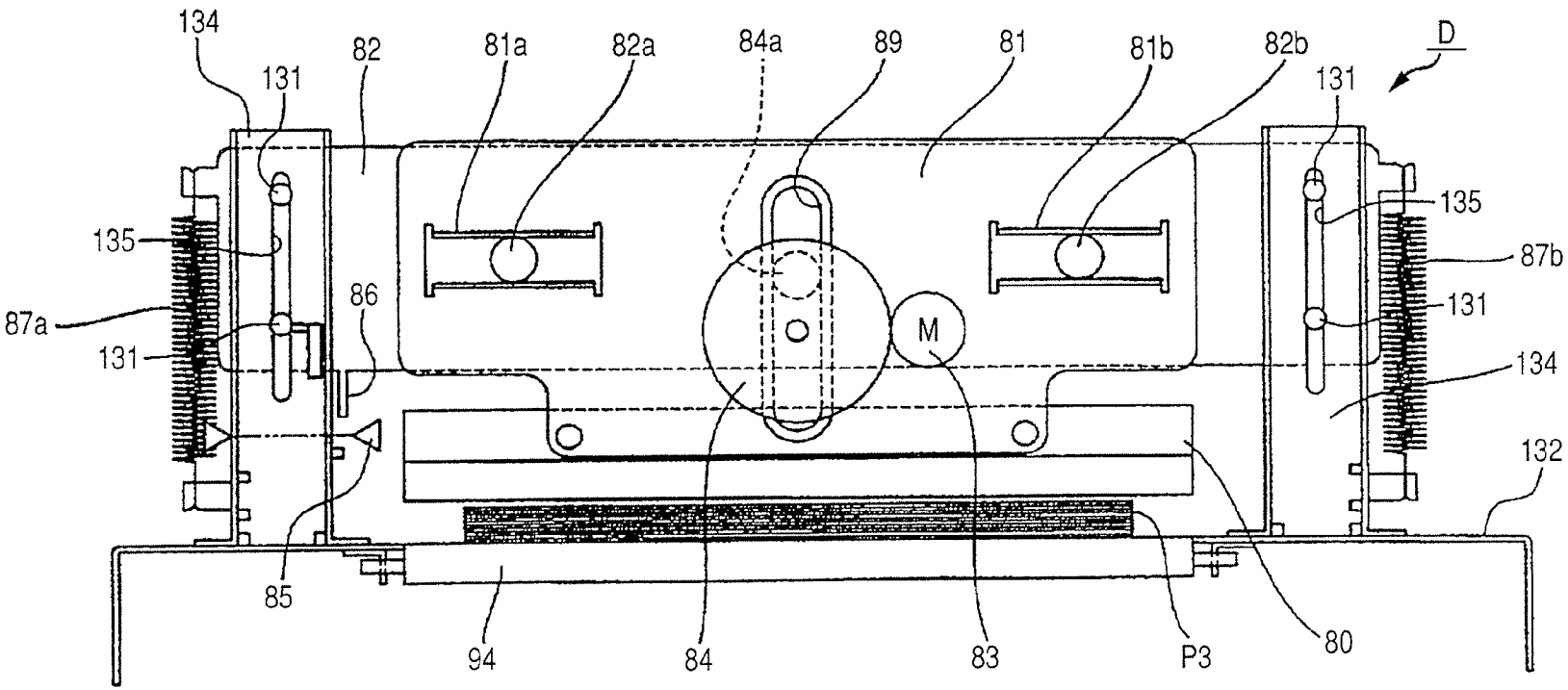
FIG. 10 is a side view of a trimmer unit provided in the sheet processing apparatus.

FIG. 10 is a side view of the trimmer unit D, which is equipped, for example, with a cutting knife 80 serving as a cutting-knife-edged tool for cutting the bookbinding sheet bundle P3. Here, the cutting knife 80, which is an example of a cutting device, is formed as a plate, which exhibits an inclination on only one side. Further, the longitudinal length of the plate-like cutting knife 80 is larger than the maximum size of the sheet to be cut. Further, since it moves in the longitudinal direction, it is always long enough to be placed on the bookbinding sheet bundle P3.

The cutting knife 80 is fixed to a longitudinal movement member 81. The longitudinal movement member 81 is supported by rollers 82*a* and 82*b* provided on a vertical movement member 82, and is adapted to move in the longitudinal direction of the longitudinal movement member 81 itself, that is, parallel to the cut surface of the bookbinding sheet bundle P3, through the rollers 82*a* and 82*b* and abutment portions 81*a* and 81*b* formed in the longitudinal movement member 81 itself.

The longitudinal parallel movement of the longitudinal movement member 81 is effected through conversion of a rotating motion of a horizontal motor 83 into a linear reciprocating motion, the conversion being effected as follows: when the horizontal motor 83 rotates, a rotary cam 84 rotates, and the above-mentioned conversion is effected through engagement of a protrusion 84*a* of the rotary cam 84 with a rotation receiving portion 89 formed as an elongated hole in the longitudinal movement member 81 itself. The speed of the reciprocating motion can be freely adjusted by providing the horizontal motor 83 with an encoder.

The movement of the cutting knife 80 in the thickness direction of the bookbinding sheet bundle P3 is effected by the vertical movement member 82. Here, the vertical movement member 82 moves toward and away from the bookbinding sheet bundle P3 by moving along columns 134 provided on a base 132, the vertical movement member 82 being guided by guide pins 131 protruding from the vertical movement member 82 and by guide grooves 135 formed in the columns 134.

Here, the vertical movement member 82 is equipped with the rollers 82*a* and 82*b* supporting the longitudinal movement member 81, so when the vertical movement member 82 moves vertically, the longitudinal movement member 81 also moves vertically, and the cutting knife 80 also moves vertically. Further, to impart a load (i.e., cutting force) to the cutting knife 80, the vertical movement member 82 is constantly pulled toward the bookbinding sheet bundle P3 by tension springs 87*a* and 87*b*.

Figure 11B:
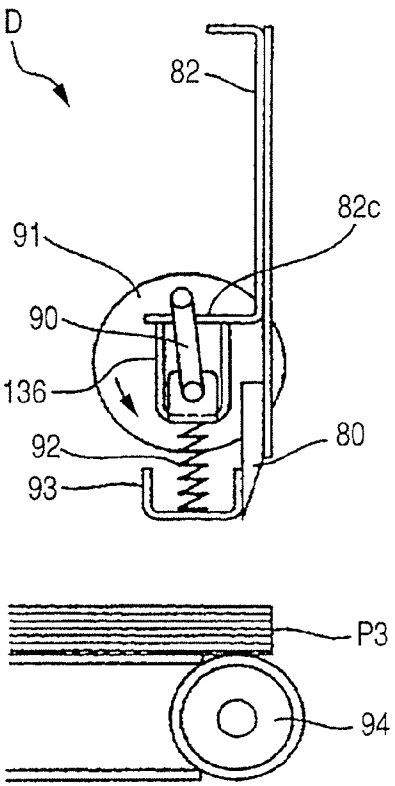
FIGS. 11A and 11B are diagrams illustrating the operation of a sheet bundle presser provided in the trimmer unit.
Figure 11A:
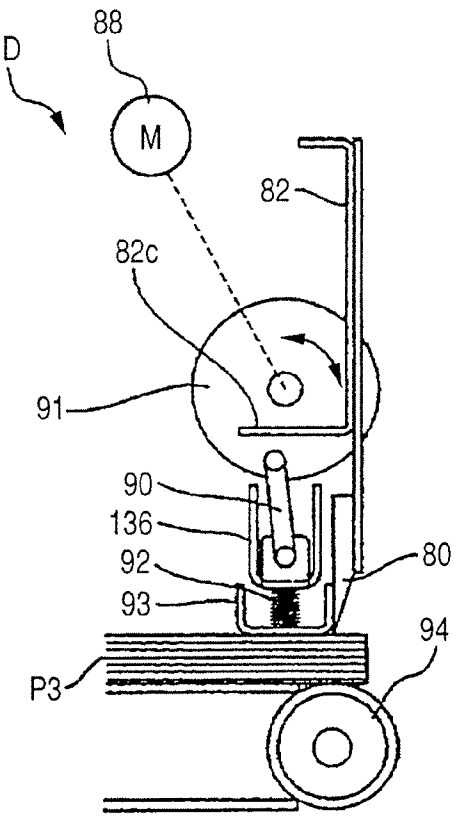

As shown in FIGS. 11A and 11B, in order to prevent breakage of the cutting knife 80, the trimmer unit D is equipped with, for example, a mat 94 serving as a member for receiving the cutting knife 80, and a sheet presser 93 as an example of the sheet presser device for fixing the bookbinding sheet bundle P3 in position while pressing the bookbinding sheet bundle P3 toward the mat 94 when cutting the bookbinding sheet bundle P3, which is the sheet bundle to be cut.

As shown in FIG. 11A, by means of a cam 91 and a link 90 adapted to rotate through rotation of a vertical motor 88, the sheet presser 93 moves to a position near the bottom dead center of the link 90. Then, the sheet presser 93 comes into contact with the bookbinding sheet bundle P3, and presses the bookbinding sheet bundle P3 against the mat 94 through a further push-down force of the link 90 exerted against the force of a sheet presser spring 92.

Here, while the link 90 thus moves to the position of the bottom dead center, a mounting member 136 of the link 90 is separated from a bumping member 82*c* of the vertical movement member 82. That is, while the link 90 moves to the bottom dead center, the bumping member 82*c* descends, following the movement of the mounting member 136. As a result, as described below, the cutting knife 80 is caused to descend in the thickness direction of the bookbinding sheet bundle P3 by the tension springs 87*a* and 87*b* through the vertical movement member 82, and the cutting knife 80 comes into contact with the bookbinding sheet bundle P3. As shown in FIG. 11A, when the cutting knife 80 comes into contact with the bookbinding sheet bundle P3, the bumping member 82*c* is separated from the mounting member 136.

The mechanism for thus operating the sheet presser 93 and the cutting knife 80 also serves as a mechanism in which, as shown in FIG. 11B, when the cam 91 rotates and the link 90 moves to the top dead center to release the pressing of the bookbinding sheet bundle P3 by the sheet presser 93, the mounting member 136 of the link 90 abuts the bumping member 82*c* of the vertical movement member 82, causing the cutting knife 80 to move upward in the thickness direction of the bookbinding sheet bundle P3 through the vertical movement member 82. Through these mechanisms, the cutting knife 80 can reciprocate in the thickness direction of the bookbinding sheet bundle.

Further, as shown in FIG. 10, the bumping member 82*c* of the vertical movement member 82 is equipped with a knife position sensor flag 86, and the column 134 is provided with a knife position sensor 85 for detecting the knife position sensor flag 86. The cutting of the bookbinding sheet bundle P3 by the cutting knife 80 is conducted until the knife position sensor 85 detects the knife position sensor flag 86.

Figure 12:
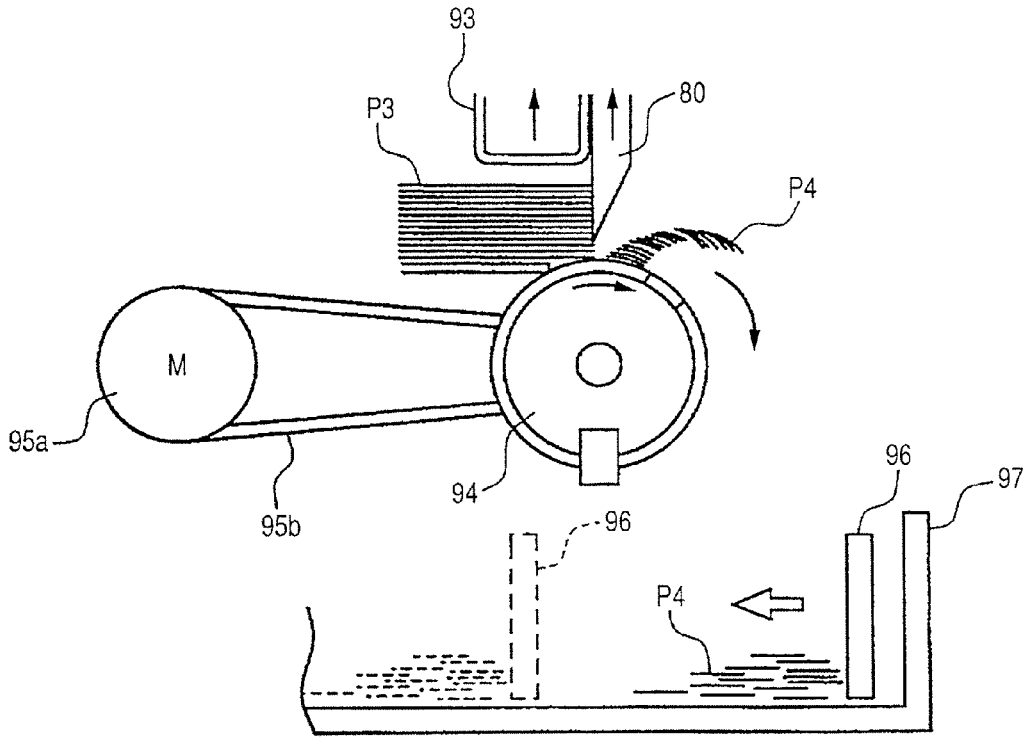
FIG. 12 is a diagram illustrating the operation of dropping cut sheet dust of the trimmer unit in front of a pusher through rotation of a mat and discharging the cut sheet dust into a dust box.

In this embodiment, in order to prevent breakage of the cutting knife 80, the mat 94 provided under the bookbinding sheet bundle P3 is formed as a roller, which is adapted to rotate in the direction indicated by the arrow in FIG. 12. In FIG. 12, a dust box 97, for example, is provided below the mat 94. The dust box 97 serves as a device for storing cut sheet dust P4 after the cutting.

By thus forming the mat 94 as a roller, it is possible to drop the cut sheet dust P4 after the cutting into the dust box 97 through rotation. To prevent damage of the cutting knife 80, it is desirable for the mat 94 to be formed of a soft material such as rubber, urethane, or mold.

Next, the operation of the trimmer unit D will be described.

First, when the bookbinding sheet bundle P3 is conveyed from the rotary stage 60 by the above-mentioned gripper unit 70 shown in FIG. 8C, the trimmer unit D starts the vertical motor 88 shown in FIG. 11A and causes the cam 91 to rotate until the link 90 reaches the bottom dead center. With this operation, the link 90 brings the sheet presser 93 into contact with the bookbinding sheet bundle P3 through the intermediation of the sheet presser spring 92. Further, through the subsequent rotation of the cam 91, the sheet presser spring 92 is compressed, whereby the sheet presser 93 is moved to the pressing position, where it presses the bookbinding sheet bundle P3 against the mat 94 to fix the bookbinding sheet bundle P3 in position.

At this time, the link 90 operates with the sheet presser 93, and as a result, the mounting member 136 moves away from the bumping member 82*c* of the vertical movement member 82. Accordingly, the vertical movement member 82 is pulled by the tension springs 87*a* and 87*b* to descend, following the movement of the mounting member 136. As a result of the descent of the mounting member 136, the cutting knife 80 descends, and the cutting knife 80 comes into contact with the bookbinding sheet bundle P3.

Next, after the cutting knife 80 thus comes into contact with the bookbinding sheet bundle P3, the horizontal motor 83 shown in FIG. 10 starts, and the rotating motion of the horizontal motor 83 is converted into a reciprocating motion by the rotary cam 84, the protrusion 84*a*, and the rotation receiving portion 89. As a result, the longitudinal movement member 81 reciprocates integrally with the cutting knife 80 in a direction perpendicular to the thickness direction of the bookbinding sheet bundle P3. That is, the cutting knife 80 reciprocates horizontally in FIG. 10.

Through this reciprocating motion, the cutting of the bookbinding sheet bundle P3 is started. Further, the cutting knife 80 is pulled by the tension springs 87*a* and 87*b* and moves in the thickness direction of the bookbinding sheet bundle P3 while cutting the bookbinding sheet bundle P3. The cutting of the bookbinding sheet bundle P3 through the reciprocating motion of the cutting knife 80 is conducted until the knife position sensor flag 86 is detected by the knife position sensor 85.

Next, after the completion of the cutting of the bookbinding sheet bundle P3 through the reciprocating motion of the cutting knife 80, the vertical motor 88 is rotated again, and the cam 91 is rotated until the link 90 reaches the top dead center to separate the sheet presser 93 from the bookbinding sheet bundle P3, causing it to move to the standby position shown in FIG. 11B and separating the cutting knife 80 from the mat 94.

As shown in FIG. 12, while a portion of the cut sheet dust P4 drops into the dust box 97, the remaining portion thereof stays on the mat 94. In view of this, in this embodiment, after the cutting knife 80 is separated from the mat 94, the mat 94 is rotated in the direction indicated by the arrow in FIG. 12 by a mat rotating motor 95*a* through a mat drive belt 95*b*.

By thus rotating the mat 94, the cut sheet dust P4 does not remain on the mat 94 but drops into the dust box 97 and in front of a pusher 96. After that, the cut sheet dust P4 is pushed toward the downstream side within the dust box 97 by the pusher 96.

After the dust disposal rotating operation of the mat 94, the bookbinding sheet bundle P3 is rotated by 90 degrees again, and the end portions of the three sides thereof other than the pasted portion are cut. Finally, the bookbinding sheet bundle P3 with the three side end portions thereof cut away is discharged onto the stack tray E.

Figure 13:
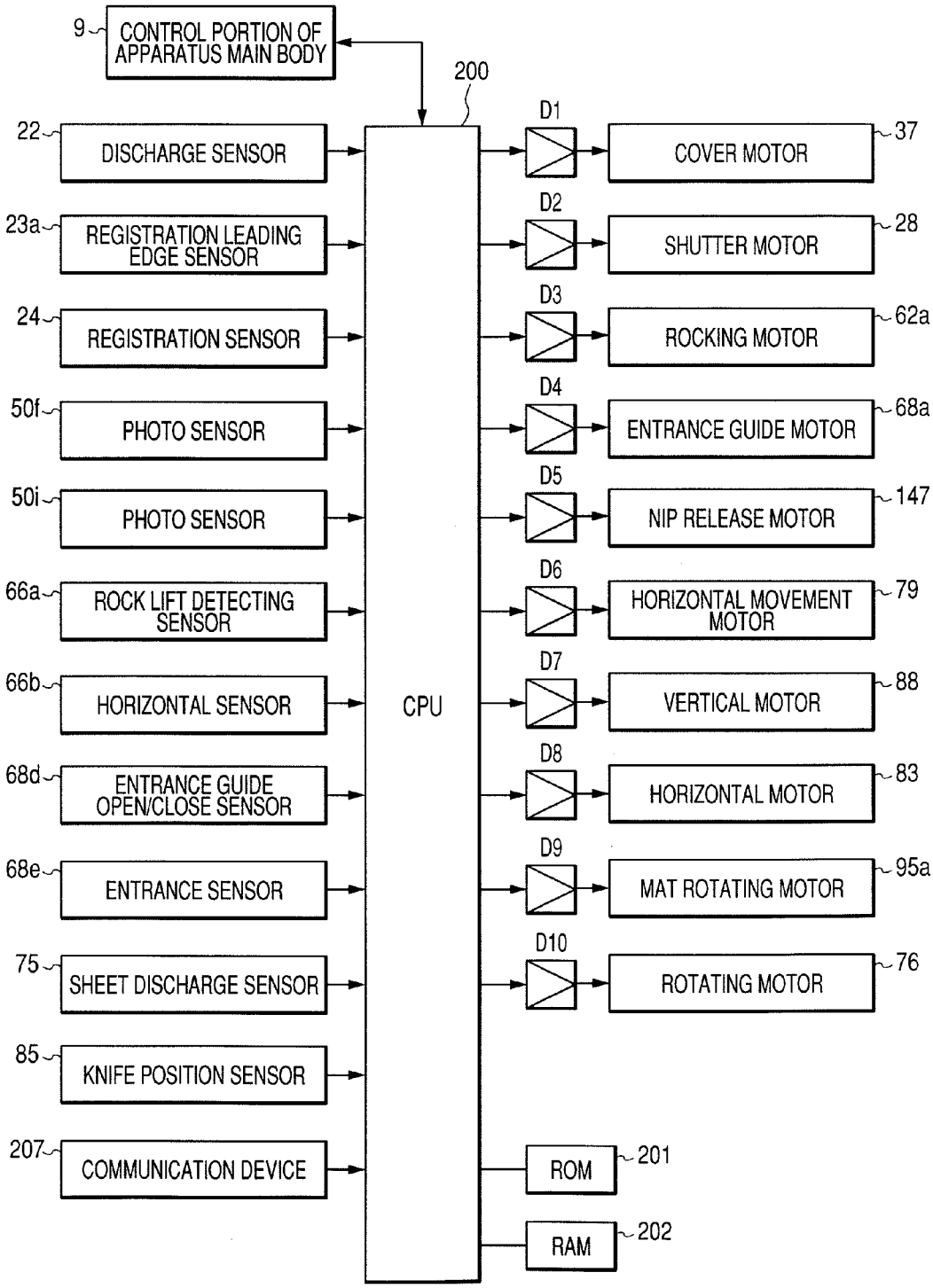
FIG. 13 is a control block diagram for the sheet processing apparatus.

FIG. 13 is a control block diagram showing the sheet processing apparatus B equipped with the trimmer unit D constructed as described above. In FIG. 13, electrically connected to, for example, the input side of the CPU 200 serving as the control means of this embodiment are: a discharge sensor 22 for detecting sheets sent into the alignment vertical path 35 (see FIG. 2), a registration leading edge sensor 23*a* for detecting whether a sheet is supplied to the registration roller pair 23, the registration sensor 24 (see FIG. 5) for detecting any movement of a sheet in a direction crossing the sheet conveying direction, the photo sensors 50*f* (see FIG. 4) for detecting movement of the moving members 50*n*, the photo sensors 50*i* for detecting movement of the receiving pads 50*a* and the racks 50*b*, the rock lift detecting sensor 66*a* (see FIG. 8A) for detecting upward rotation of the rocking unit 61, the horizontal sensor 66*b* for detecting downward rotation of the rocking unit 61, the entrance guide open/close sensor 68*d* for detecting movement of the entrance guide 67, the entrance sensor 68*e* for detecting any sheet sent into the entrance guide 67, the sheet discharge sensor 75 for detecting a sheet discharged from the rotary stage 60, the knife position sensor 85 for detecting the position of the cutting knife 80, a communication device 207 for transmitting the sheet size data designated by the user to the CPU 200, etc.

Electrically connected to the output side of the CPU 200, respectively through drivers D1, D2, D3, D4, D5, D6, D7, D8, D9, and D10, are: the cover motor 37 (see FIG. 5) for moving the cover sheet P2, the shutter motor 28 for operating the creasing stages 34 (see FIGS. 6A through 6D), the rocking motor 62*a* for rotating the rocking unit 61 (see FIG. 8A), the entrance guide motor 68*a* for moving the entrance guide 67 (see FIG. 8A), a nip release motor 147 for releasing the nipping of the bookbinding sheet bundle by the gripper unit 70, the horizontal movement motor 79 (see FIG. 9) for moving the gripper unit 70, the vertical motor 88 (see FIG. 11A) for raising and lowering the sheet presser 93, the horizontal motor 83 (see FIG. 10) for moving the cutting knife 80 parallel to the sheet surface, the mat rotating motor 95*a* (see FIG. 12) for rotating the mat 94, and the rotating motor 76 (see FIG. 8C) for rotating the rotation guide gear 78. Further, a plunger (not shown), etc. are also electrically connected to the output side of the CPU 200.

Further, the CPU 200 has, for example, a ROM 201 and a RAM 202 as memories which serve as storage portions. The ROM 201 stores, for example, cutting control procedures, etc. for each size of bookbinding sheet bundle to be executed by the CPU 200. The RAM 202 is a portion for temporarily storing sheet size, etc. input by the user.

When signals from the above-mentioned sensors, the ROM 201, and the RAM 202 are input to the CPU 200, the CPU 200 controls the motors, plungers (not shown), etc. to execute the cutting control, etc. based on the signals. Further, the CPU 200 performs signal exchange with the control portion 9 in the apparatus main body A of the copying machine G to control the sheet processing apparatus B as a whole.

In this embodiment, according to the number of sheets and thickness of the bookbinding sheet bundle P3 constituting the sheet bundle to be cut, the sheet presser 93 is previously moved from the standby position to an optimum standby position, which is a predetermined proximity standby position on the pressing position side with respect to the standby position, whereby the distance between the standby position for the sheet presser 93 and the pressing position is shortened. Accordingly, the requisite time for pressing the bookbinding sheet bundle P3 to fix it in position is shortened to thereby shorten the requisite processing time for cutting the bookbinding sheet bundle P3.

Next, an optimum method of controlling the standby position for the sheet presser 93 will be described.

Figure 14:
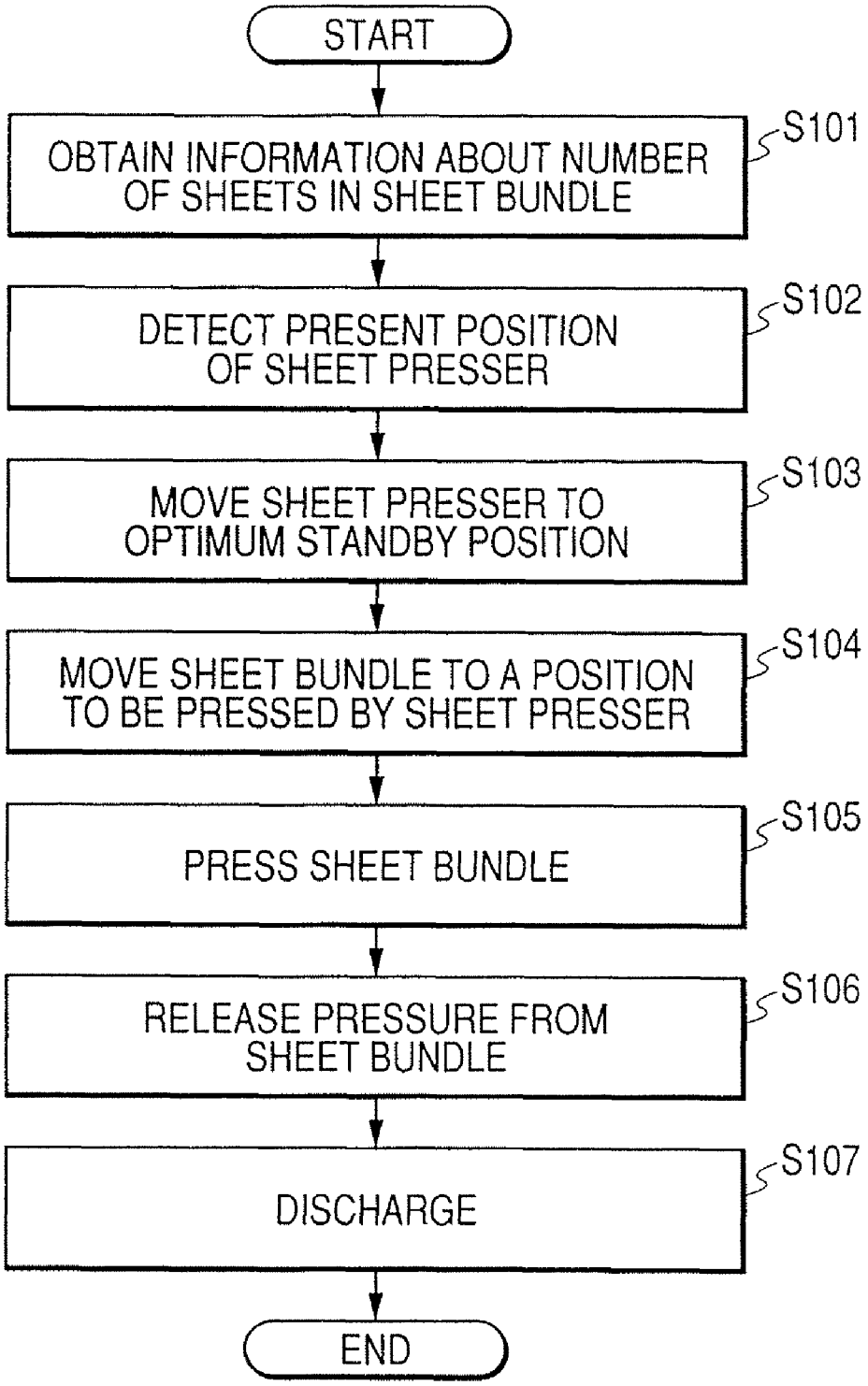
FIG. 14 is a flowchart of a standby position control for a sheet bundle presser provided in the trimmer unit.

First, an example of the processing procedures for one job using the standby position control and performed with the sheet presser 93 of the trimmer unit D will be described with reference to the flowchart of FIG. 14.

When a job is started, the CPU 200 serving as an information obtaining means obtains information on the thickness or the number of sheets of the sheet bundle to be processed (S101). In this embodiment, in obtaining the sheet bundle information, information on the number of sheets of the sheet bundle is stored in the RAM 202 from the apparatus main body A through the communication device 207. When the job is started, the CPU 200 obtains information on the number of sheets in the sheet bundle from the RAM 202.

Next, the current position of the sheet presser 93 is detected (S102), and when the sheet presser 93 has not moved to the optimum standby position yet, the vertical motor 88 is driven based on the obtained information on the number of sheets to move the sheet presser 93 to the optimum standby position (S103). When the position of the sheet presser 93 is undefined, the position of the sheet presser 93 is made sure by, for example, causing the sheet presser 93 to be temporarily retracted to the home position to thereby move the sheet presser 93 to the optimum standby position.

Here, the calculation of the optimum standby position will be described with reference to FIG. 15.

Assuming that, in a case where the sheet presser 93 stands by at a home position which is an example of a standby position, the sheet reception width between the bottom surface constituting the sheet pressing surface of the sheet presser 93 and the mat 94 is M, the number of sheets is n, the thickness of a sheet with maximum thickness allowing conveyance by the apparatus main body A is L, and that the margin is K, when processing a sheet bundle whose number of sheets is n, it is optimum for the sheet presser 93 to standby at a position expressed as nL+K, which is to be regarded as the optimum standby position.

When the optimum standby position for the sheet presser 93 is thus calculated, the CPU 200 drives the vertical motor 88, and lowers the sheet presser 93 in advance from the home position by the distance M−(nL+K) to move the sheet presser 93 to the optimum standby position. Here, an encoder (not shown) is mounted to the vertical motor 88, and the CPU 200 can calculate the moving amount of the sheet presser 93 from the clock number of the encoder.

After that, the bookbinding sheet bundle P3 is, as described above, transferred by the gripper unit 70 to a position below the sheet presser 93 where it is pressed by the sheet presser 93 (S104). While the thickness of the thickest sheet is L in this embodiment, it is also possible to obtain a sheet thickness signal or a sheet kind signal from the apparatus main body A to change the thickness according to the signal.

Figure 15:
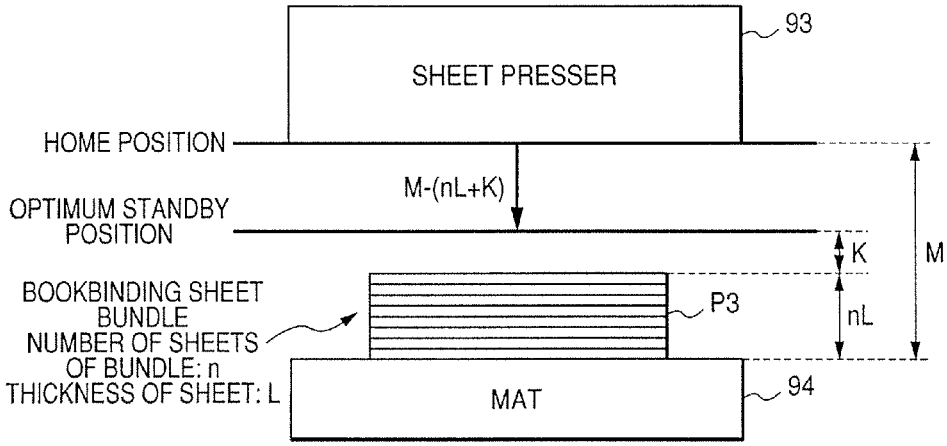
FIG. 15 is a diagram showing an optimum standby position for the sheet bundle presser.

Next, when the bookbinding sheet bundle P3 is thus conveyed to the position where the bookbinding sheet bundle P3 is pressed by the sheet presser 93, in other words, the sheet cutting position, the vertical motor 88 is then driven, and the sheet presser 93, which has previously moved to the optimum standby position shown in FIG. 15, is activated to be brought into press contact with the bookbinding sheet bundle P3 and press the bookbinding sheet bundle P3. Then, after the processing of pressing the bookbinding sheet bundle P3 has been conducted (S105), the horizontal motor 83 is driven, and the cutting of the bookbinding sheet bundle P3 is effected by the cutting knife 80.

After the completion of the cutting processing, the vertical motor 88 is driven to cancel the pressing of the bookbinding sheet bundle P3 by the sheet presser 93 (S106), and the cut bookbinding sheet bundle P3 is discharged from the trimmer unit D (S107), whereby the job is completed.

Figure 16:
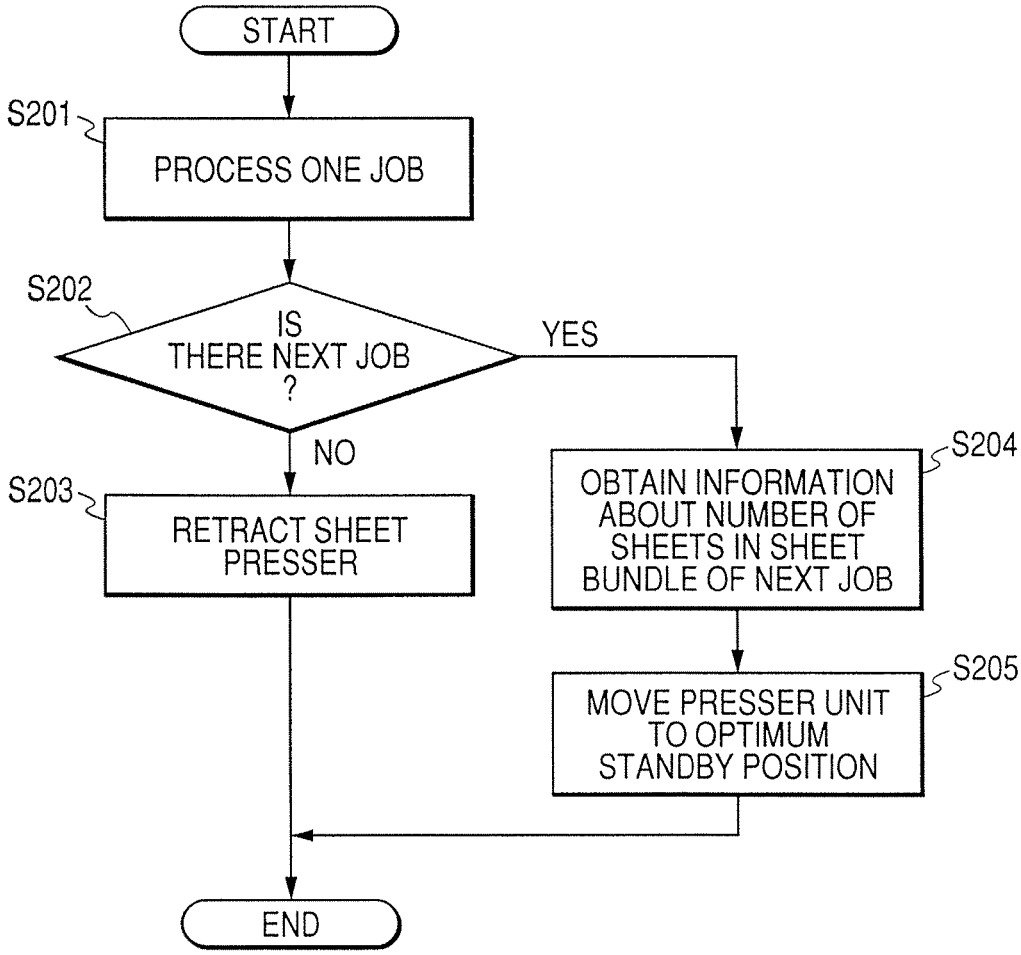
FIG. 16 is a standby position control flowchart for successive jobs to be performed by the sheet bundle presser.

Next, an example of the standby position control method for each job in successive jobs for the sheet presser 93 of the trimmer unit D will be described with reference to the flowchart of FIG. 16.

After the completion of the processing of one job (S201), when there is no next job (that is, when the answer in S202 is NO), the CPU 200 retracts the sheet presser 93 to complete the processing (S203). At this time, it is possible for the sheet presser to be retracted to the home position, which is the initial standby position, and it is also possible to arbitrarily determine the standby position and retract the sheet presser, for example, to an intermediate position.

When, after the completion of one job (S201), it is determined that there is a next job (that is, when the answer in S202 is YES), information on the number of sheets of the sheet bundle constituting the object of processing of the next job stored in the RAM 202 is previously obtained from the apparatus main body A through the communication device 207 (S204). After that, the optimum standby position is calculated in the same manner as described above, and the sheet presser 93 is moved to the optimum standby position (S205) to be made ready for the processing of the next job.

In this way, prior to the operation of fixing the bookbinding sheet bundle P3 in position through pressing by the sheet presser 93, the standby position for the sheet presser 93 is optimized based on the information on the thickness of the bookbinding sheet bundle P3, and control is previously effected to reduce the distance between the standby position and the pressing position, whereby it is possible to shorten the requisite time for pressing the bookbinding sheet bundle P3. As a result, it is possible to achieve an enhancement in productivity.

In this embodiment, the information obtaining means (CPU 200) obtains the information on the thickness of the bookbinding sheet bundle P3 by receiving information on the number of sheets from the apparatus main body A through the communication device 207. In another method, however, it is possible to obtain information on the number of sheets by counting the number of sheets conveyed before performing the bookbinding.

Figure 17:
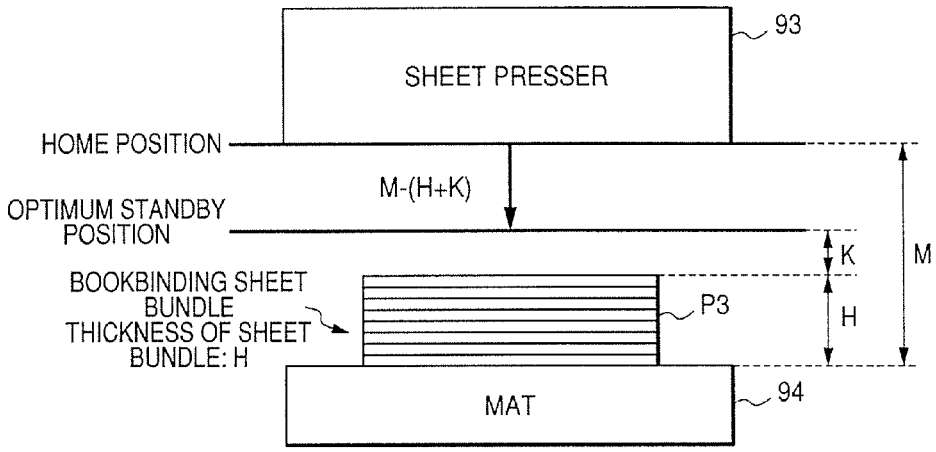
FIG. 17 is a diagram showing an optimum standby position for the sheet presser.

In still another method, there is provided a sheet thickness detection mechanism for detecting the thickness of the nipped sheets by a variable resistor, a distance detection sensor (optical sensor or the like), etc., by which the thickness is directly detected, and the detected thickness information is obtained by an information obtaining means. As shown in FIG. 17, assuming that the detected sheet thickness is H, the margin is K, and the sheet reception width is M, the optimum standby position for each sheet bundle thickness in this case is the position attained by lowering the bundle by the distance M−(H+K) from the home position.

In this way, as the methods of obtaining information on the thickness of the bookbinding sheet bundle P3, there are the method in which the information is obtained by detecting and calculating the number of sheets, and the method in which the information is obtained through detection of the thickness. However, the information on the thickness of the bookbinding sheet bundle P3 may be obtained through provision of one or both of these detecting means. While, in this embodiment, the optimum standby position for the sheet presser 93 is a position different from the home position, the home position is used as the optimum standby position in some cases.

In this embodiment, the standby position for the sheet presser 93 is changed according to the number of sheets to be processed. This is due to the fact that the mat 94, which is an example of the receiving member for nipping the bookbinding sheet bundle P3 together with the sheet presser 93 when the sheet presser 93 reaches the pressing position, and for receiving the cutting knife 80 when the bookbinding sheet bundle P3 is cut by the cutting knife 80, is stationary. However, the same effect can be obtained by making the standby position for the sheet presser 93 stationary, making the mat 94 vertically movable by a moving member (not shown), and changing the position of the mat 94 according to the number of sheets to be processed. Further, the same effect can also be obtained by changing the respective standby positions of the sheet presser 93 and the mat 94 by moving members according to the number of sheets to be processed.

Further, while in this embodiment the standby position for the sheet presser 93 is optimized, it is also possible to optimize the standby position for some other mechanism driven in the thickness direction of the bookbinding sheet bundle, such as the face presser unit or the gripper unit, according to the thickness of the sheet bundle to be processed.

While in the mechanism described above the requisite processing time for cutting the bookbinding sheet bundle P3 is reduced by previously moving the sheet presser 93 to an optimum position according to the number of sheets and the thickness of the sheet bundle to be cut, the present invention is not restricted to this mechanism. By starting the sheet bundle pressing operation of the sheet presser 93 with an optimum timing according to the thickness and the number of sheets of the sheet bundle to be cut, it is possible to eliminate the unnecessary moving time involved when activation and processing are effected with the same timing, thereby making it possible to achieve an enhancement in productivity.

Next, the second embodiment of the present invention will be described.

Figure 18:
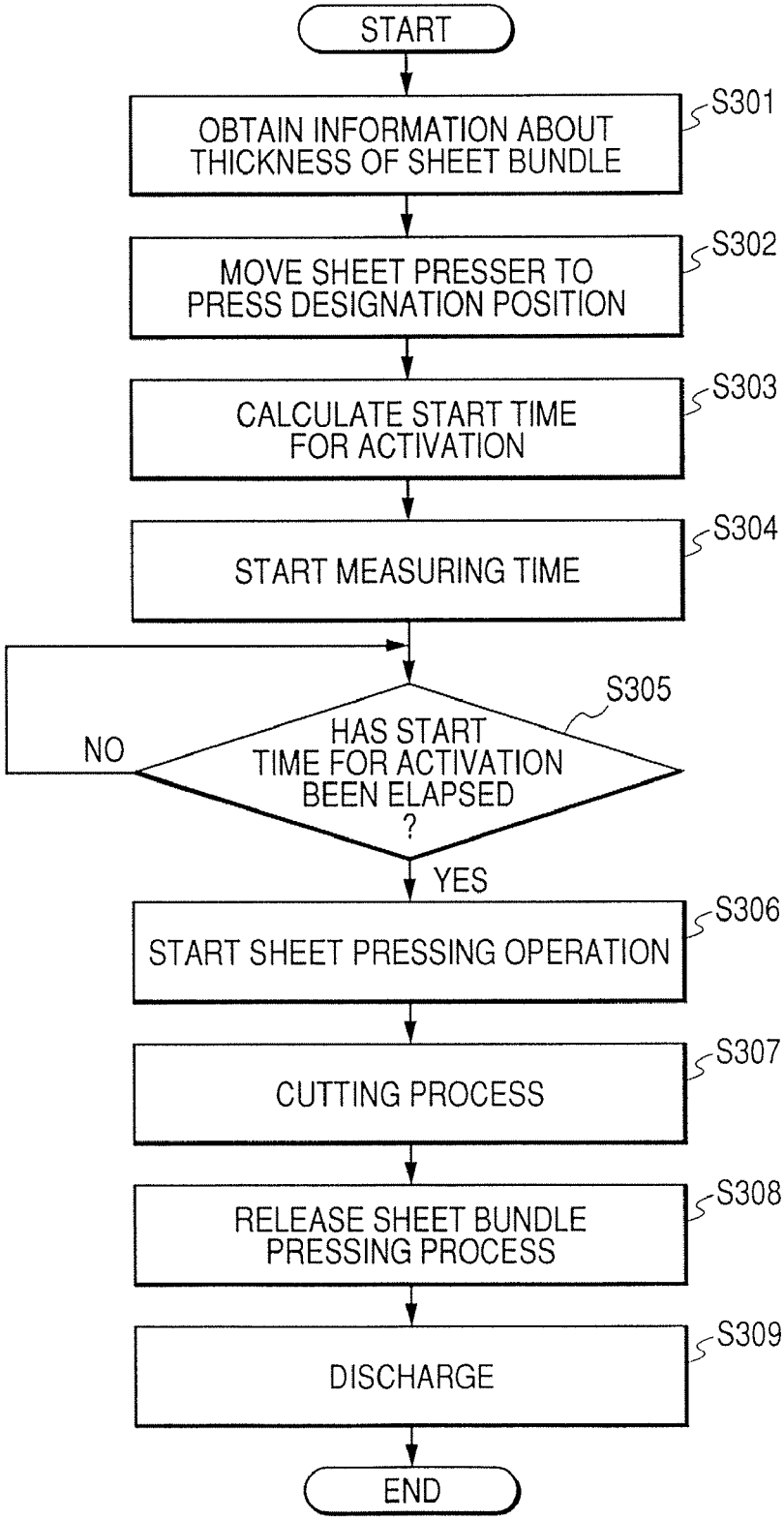
FIG. 18 is an activation timing control flowchart for a sheet bundle presser provided in a trimmer unit according to a second embodiment of the present invention.

FIG. 18 is a flowchart showing an example of the processing procedures for one job using activation timing control for the sheet presser 93 of the trimmer unit D. With reference to this flowchart, an example of the processing procedures for one job according to this embodiment using standby position control will be described.

When a job is started, the CPU 200 serving as the information obtaining means obtains information on the thickness or the number of sheets of the sheet bundle to be processed (S301). In this embodiment, to obtain sheet bundle information, information on the number of sheets of the sheet bundle is stored in the RAM 202 from the apparatus main body A through the communication device 207. When the job is started, the CPU 200 obtains information on the number of sheets of the sheet bundle from the RAM 202.

Next, the current position of the sheet presser 93 is checked. When the sheet presser is not at the standby position, the sheet presser 93 is moved to a press designation position, which is a designated standby position (S302). In this embodiment, the press designation position (i.e., the standby position) serves as the home position.

Next, based on the obtained information on the number of sheets of the bookbinding sheet bundle P3, the start time for activation of the sheet presser 93, which is the time that elapses from a certain point in time during the processing of the job to the time when the sheet presser 93 is activated, is calculated (S303). Here, in this embodiment, the certain point in time during the processing is the point in time when the trimmer unit D receives the bookbinding sheet bundle and starts the processing, and the time from this point in time to the time when the activation of the sheet presser 93 is started is calculated (S303). It is not always necessary for the point in time during the processing to be the above-mentioned one.

Next, when the bookbinding sheet bundle P3 is conveyed to the trimmer unit D, the measurement of the elapse of time is started (S304). When the calculated start time for activation has elapsed (i.e., when the answer in S305 is YES), the sheet pressing operation is started (S306). When, after that, the conveyance of the bookbinding sheet bundle P3 to the cutting position is completed, and the pressing processing is completed, the bookbinding sheet bundle P3 is cut (S307). When the cutting of the bookbinding sheet bundle P3 is completed, the sheet bundle pressing process by the sheet presser 93 is canceled (S308). After that, the cut bookbinding sheet bundle P3 is discharged (S309), whereby the processing of one job is completed.

Next, an example of the method of calculating the activation timing for the sheet presser 93 in the job will be described with reference to FIGS. 19A, 19B, and 20.

Figure 19A:
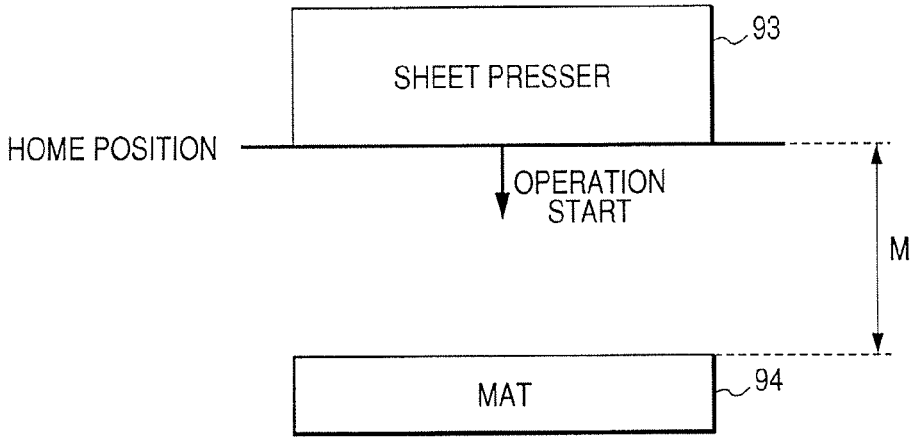
FIG. 19A is a diagram showing a position of the sheet bundle presser when it is on standby during the activation timing control.

FIG. 19A shows the position (i.e., the standby position) of the sheet presser 93 prior to activation. FIG. 19B shows an optimum standby position for the sheet presser 93 at the time of the completion of the conveyance of the bookbinding sheet bundle to the sheet pressing position, which is below the sheet presser 93 and which is the position where the sheet bundle is pressed by the sheet presser 93. FIG. 20 shows, in chronological order, the processing timing for the conveyance, the sheet pressing, and the cutting in the sheet cutting apparatus when the activation timing control for the sheet presser 93 is effected and when this control is not effected.

Figure 19B:
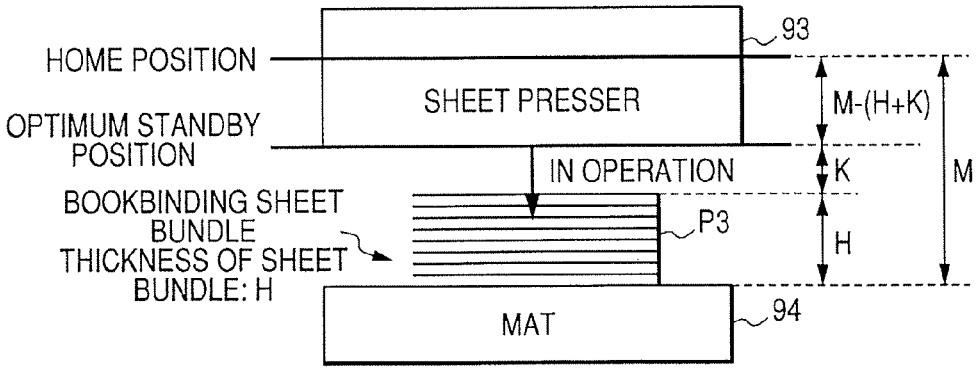
FIG. 19B is a diagram showing a position of the sheet bundle presser at the time of completion of the conveyance of a bookbinding sheet bundle during the activation timing control.

The target activation timing for the sheet presser 93 is such that when the conveyance of the bookbinding sheet bundle P3 to the sheet pressing portion is completed, the sheet presser 93, which has already been activated from the standby position of FIG. 19A and in operation, has reached the optimum standby position of FIG. 19B.

Here, assuming that the sheet reception width between the bottom surface of the sheet presser 93 and the mat 94 when the sheet presser 93 is on standby at the home position is M, that the thickness of the sheet bundle is H, and that the margin is K, the optimum standby position of FIG. 19B is the position to be expressed as H+K. This position is a position where, even during the conveyance of the sheet bundle, there is no fear of the sheets colliding with the sheet presser 93. The bundle thickness H is calculated from information "n" on the number of sheets of the bookbinding sheet bundle received from the apparatus main body A.

That is, according to this embodiment, during the conveyance of the sheet bundle to the sheet pressing portion, the sheet presser 93 is activated previously to be lowered by the distance of M−(H+K). In other words, the activation of the sheet presser is effected during, and prior to the completion of the conveyance of the bookbinding sheet bundle P3 to the position where it is to be pressed by the sheet presser 93.

Figure 20:
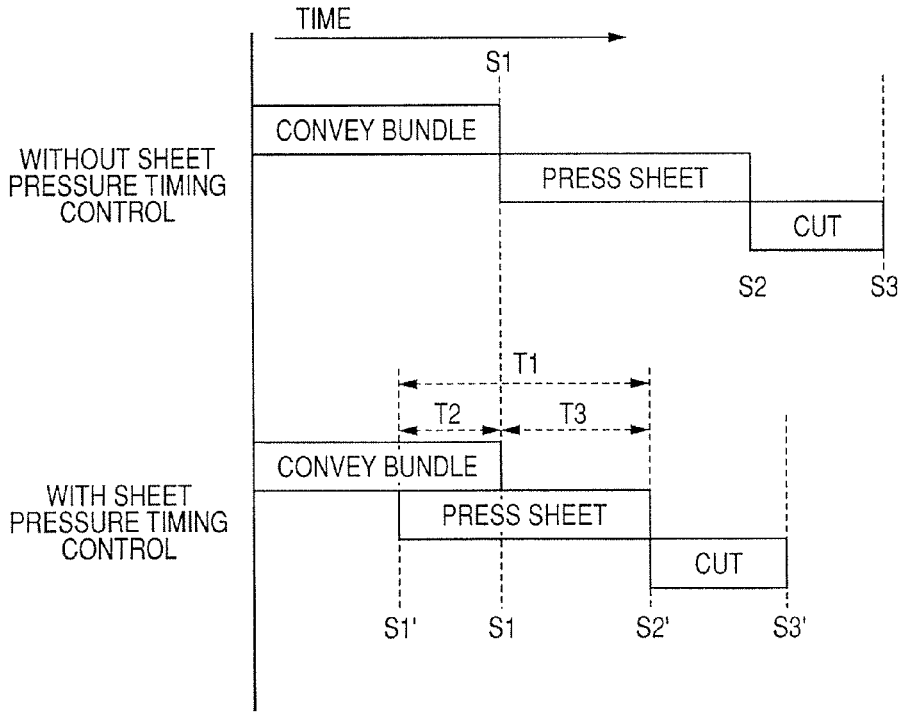
FIG. 20 is a diagram showing the processing timing with/without the activation timing control.

Here, assuming that the requisite time for moving the sheet presser 93 by the distance of M−(H+K) is T2, that the requisite time for conveying the sheet bundle to the sheet pressing portion is S1, and that the requisite time for the sheet presser from the standby position (i.e., home position) to complete the sheet pressing is T1, the processing timing control for the sheet presser 93 executed is as shown in FIG. 20.

That is, the start of the sheet pressing process is not effected at the point in time S1, which is the point in time when the bundle conveyance is completed, but at a point in time S1' during the bundle conveyance, which is earlier than S1 by T2 (=S1−T2). By thus activating the sheet presser 93 after the elapse of the time S1' since the start of the bundle conveyance, it is possible to shorten the total requisite time for completing the cutting by T2 (=S3−S3').

Next, a method of calculating the time T2 will be described.

Here, as is apparent from FIG. 19B, assuming that the moving speed in the longitudinal direction of the sheet presser 93 is V, T2 is to be expressed as follows: [M−(H+K)]/V. Thus, the activating timing S1' for the sheet presser 93 is obtained as follows: S1−[M−(H+K)]/V.

That is, the activation timing control for the sheet presser 93 is a control method in which the sheet presser 93 is activated to start operation after the elapse of the time S1' since the start of the conveyance of the bookbinding sheet bundle P3 transferred from the conveyance alignment unit C to the rotary stage 60, thereby achieving a reduction in processing time.

By thus controlling the activating timing for the sheet presser 93 based on the information on the thickness of the bookbinding sheet bundle P3, it is possible to previously reduce the distance between the standby position and the pressing position, whereby it is possible to reduce the requisite time for pressing the bookbinding sheet bundle P3, with the result that it is possible to achieve an enhancement in productivity.

While in this embodiment the information obtaining means (i.e., CPU 200) obtains information on the thickness of the bookbinding sheet bundle P3 by receiving information on the number of sheets from the apparatus main body A through the communication device 207, other methods are also available. For example, it is also possible to obtain information on the number of sheets by counting the number of sheets conveyed prior to the bookbinding, or to provide a sheet thickness detection mechanism which detects the thickness of a sheet bundle when nipped by a variable resistor, a distance detection sensor (e.g., optical sensor), etc., and detect the thickness directly by this mechanism to obtain the detected thickness information by an information obtaining means.

In this way, there are two methods of obtaining information on the thickness of the bookbinding sheet bundle P3. One is the method in which the number of sheets are detected and calculated and another is the method in which the desired information is obtained by detecting the thickness. It is possible to obtain information on the thickness of the bookbinding sheet bundle P3 by providing one or both of these detecting devices.

In this embodiment, the activation timing for the sheet presser 93 is changed according to the number of sheets to be processed. This is because the mat 94 is stationary. It is possible to obtain the same effect by making the sheet presser 93 stationary with its standby position fixed and making the mat 94 vertically movable, and changing the timing with which the mat 94 is activated toward the sheet pressing side according to the number of sheets to be processed.

Further, while in this embodiment the activation timing for the sheet presser 93 is optimized, it is also possible to optimize in the same manner the activation timing for some other mechanism driven in the thickness direction of the bookbinding sheet bundle, such as the face presser unit or the gripper unit, according to the thickness of the sheet bundle to be processed.

Next, the third embodiment of the present invention will be described.

In this embodiment, the moving (i.e., operating) speed of the sheet presser 93 is changed according to the thickness and the number of sheets of the sheet bundle to be cut.

Figure 21:
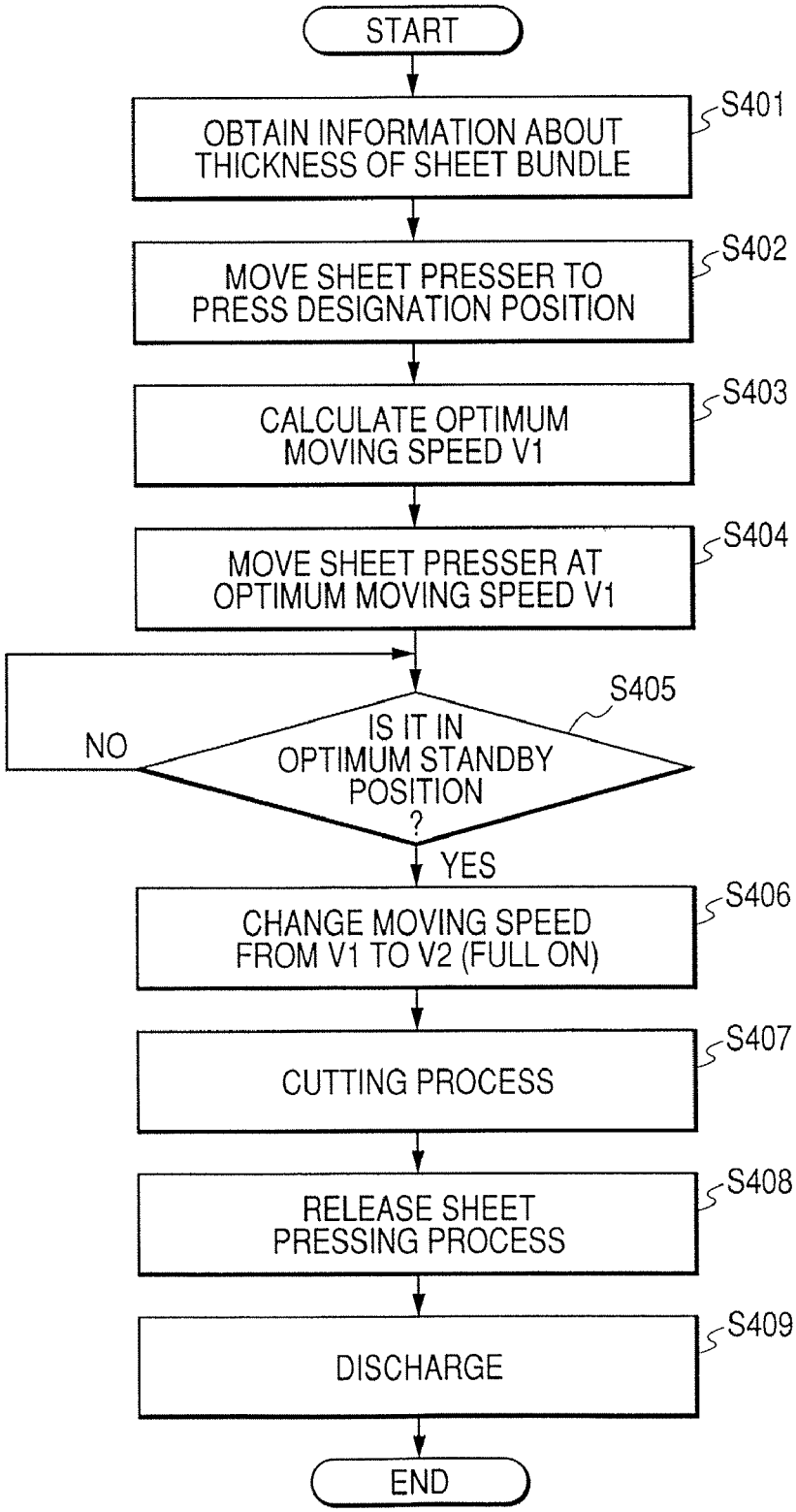
FIG. 21 is a flowchart showing the processing procedures of the moving speed control for a sheet bundle presser provided in a trimmer unit according to a third embodiment of the present invention.

FIG. 21 is a flowchart showing an example of the processing procedures for one job using moving speed control for the sheet presser 93 of the trimmer unit D. An example of the processing procedures for one job according to this embodiment using moving speed control will be described with reference to this flowchart.

When a job is started, the CPU 200 serving as an information obtaining means first obtains information on the thickness or the number of sheets of the sheet bundle to be processed (S401). In this embodiment, as the sheet bundle information, information on the number of sheets is stored in the RAM 202 from the apparatus main body A through the communication device 207. When the job is started, the CPU 200 obtains the information on the number of sheets from the RAM 202.

Next, the current position of the sheet presser 93 is checked. When the sheet presser 93 is not at the designated standby position, the sheet presser 93 is moved to a designated press designation position (S402). In this embodiment, the home position is the press designation position (i.e., standby position).

Next, based on the obtained information on the number of sheets of the bookbinding sheet bundle P3, an optimum moving speed V1 of the sheet presser 93 is calculated (S403). In this embodiment, the moving speed of the sheet presser 93 is of two stages of V1 and V2. The sheet presser 93 is started at the optimum moving speed V1, and switched halfway through to the moving speed V2, which is higher than the optimum moving speed V1. Regardless of the number of sheets of the bookbinding sheet bundle P3, the moving speed V2 is the speed when the motor is full on.

When the bookbinding sheet bundle P3 is conveyed to the trimmer unit D, the sheet presser 93 is moved at the calculated optimum moving speed V1 (S404). When, after that, the sheet presser 93 has reached the optimum standby position of the first embodiment described above (i.e., when the answer in S405 is YES), the moving speed is changed from V1 to V2 (S406), and the operation of the sheet presser 93 is continued to execute the actual pressing process.

Next, when this pressing process is completed, the cutting process is conducted (S407), and, thereafter, the sheet pressing process by the sheet presser 93 is canceled (S408). After that, the cut bookbinding sheet bundle P3 is discharged (S409), whereby the process for one job is completed.

Next, an example of the method of calculating the optimum moving speed V1 of the sheet presser 93 and an example of the details of the relevant operation will be described with reference to FIGS. 22A, 22B, 23A, and 23B.

Figure 22A:
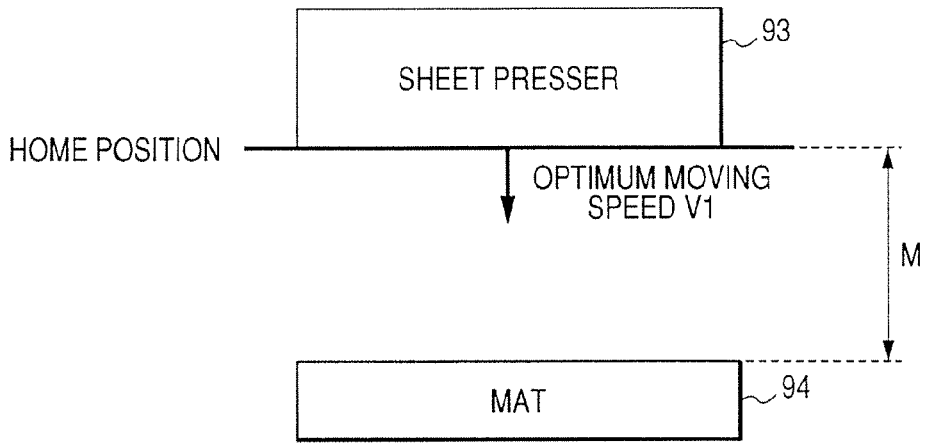
FIG. 22A is a diagram showing an activation position of the presser unit (speed V1) during the moving speed control.
Figure 22B:
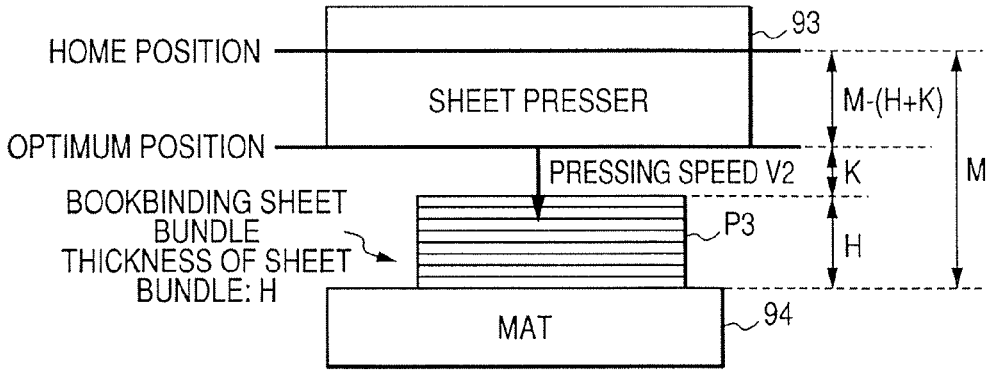
FIG. 22B is a diagram showing a pressing start position for the presser unit during the moving speed control (with the speed changed from V1 to V2).
Figure 23A:
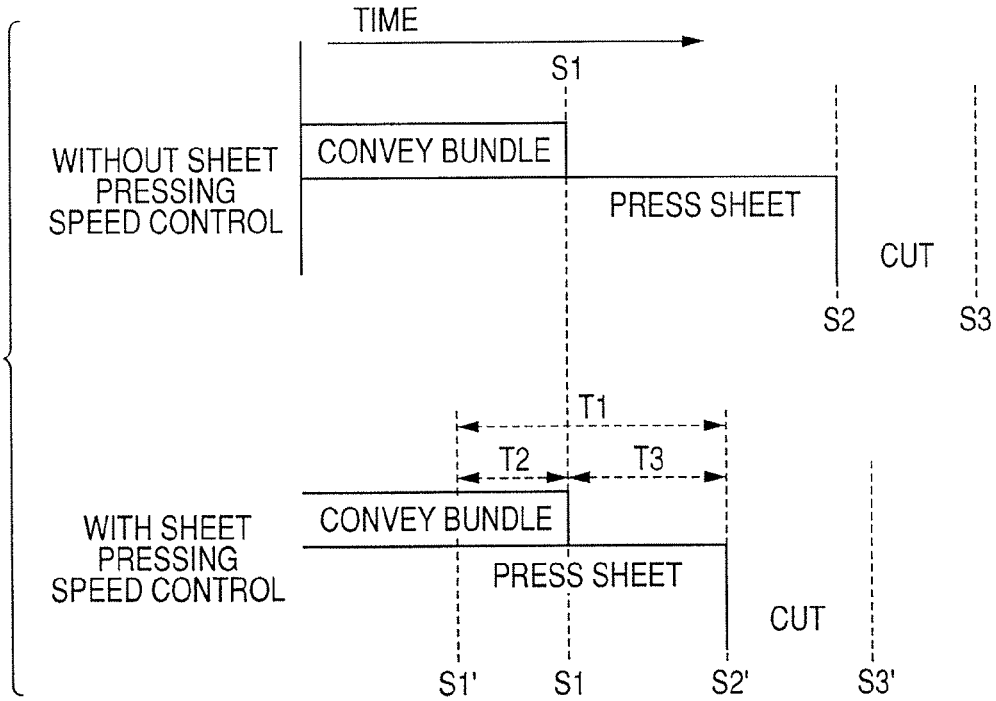
FIGS. 23A and 23B are timing charts showing the sheet pressing process in chronological order.
Figure 23B:
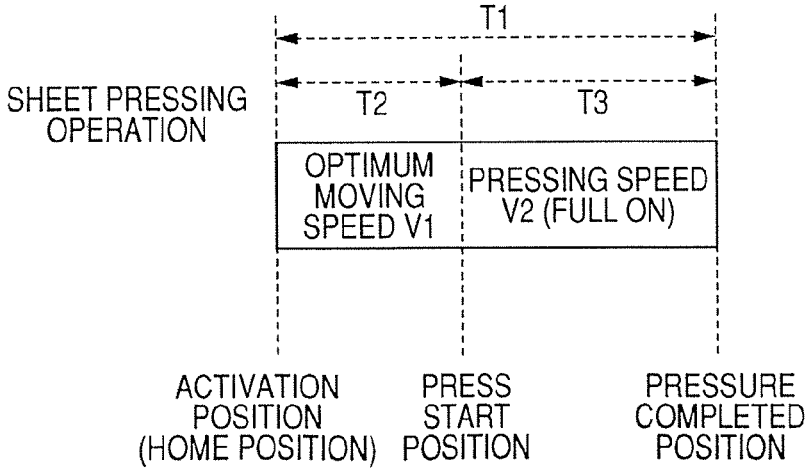

FIG. 22A shows the position of the sheet presser 93 prior to activation. FIG. 22B shows the optimum standby position for the sheet presser 93 at the point in time when the conveyance of the bookbinding sheet bundle to the sheet pressing portion has been completed. FIG. 23A shows, in chronological order, the timing with which the conveyance by the sheet cutting apparatus, the pressing of the sheets, and the cutting process are conducted. FIG. 23B shows the timing with which the switching of the speed of the sheet pressing operation is effected.

The target optimum moving speed V1 of the sheet presser 93 is such that when the conveyance of the bookbinding sheet bundle P3 to the sheet pressing portion has been completed, the sheet presser 93 in operation, activated from the position of FIG. 22A, has reached the optimum standby position shown in FIG. 22B.

Here, assuming that the sheet reception width between the bottom surface of the sheet presser 93 and the mat 94 when the sheet presser 93 is on standby at the home position is M, that the thickness of the sheet bundle is H, and that the margin is K, the optimum standby position shown in FIG. 22B is a position corresponding to H+K. This is a position where, even during the conveyance of the sheet bundle, there is no fear, for example, of the sheets colliding with the sheet presser 93. The bundle thickness H is calculated from the information "n" on the number of sheets of the bookbinding sheet bundle received from the apparatus main body A.

That is, according to this embodiment, during the conveyance of the bookbinding sheet bundle P3 to the sheet pressing portion, the sheet presser 93 is lowered by M−(H+K), whereby the sheet presser 93 can be activated during the conveyance of the sheet bundle.

As shown in FIG. 23A, the sheet presser 93 is activated at a point in time S1', which is earlier by T2 than the time S1 when the conveyance is completed. Thus, the optimum moving speed V1 is set such that the sheet presser 93 is activated at the point in time S1' and moves by the distance M−(H+K) until the time S1 when the conveyance of the sheet bundle is completed (i.e., for the period of time T2). As a result, the optimum moving speed V1 calculated is [M−(H+K)]/T2.

When the sheet presser 93 thus activated at the optimum moving speed V1 reaches the optimum standby position of FIG. 22B, and the conveying operation is completed at the same time, the moving speed (i.e., pressing speed) is switched to V2, and the sheet bundle is driven to the pressing position.

The speed of the sheet presser 93 is controlled, for example, by mounting an encoder (not shown) to the vertical motor 88 of the drive source, and increasing or decreasing the ON time for the vertical motor 88 by the CPU 200 based on the number of clocks detected by the encoder during the rotation of the motor.

In this way, prior to the operation of pressing the sheet bundle, the sheet presser 93 is moved from the standby position to the optimum standby position, and the speed at which the sheet presser 93 is moved from the standby position to the optimum standby position is controlled based on the information on the thickness of the bookbinding sheet bundle P3, whereby it is possible to shorten the requisite time for pressing the bookbinding sheet bundle P3 and, consequently, to achieve an enhancement in productivity.

While in this embodiment the information obtaining means (i.e., CPU 200) obtains information on the thickness of the bookbinding sheet bundle P3 by receiving information on the number of sheets from the apparatus main body A through the communication device 207, other methods are available. For example, there is a method in which the information on the number of sheets is obtained by counting the number of sheets conveyed prior to the bookbinding, or a method in which there is provided a sheet thickness detection mechanism for detecting the thickness of the sheet bundle nipped by a variable resistor, a distance detection sensor (e.g., optical sensor), etc., to detect the bundle thickness directly by this mechanism and obtain the detected thickness information through an information obtaining means.

In this way, the information on the thickness of the bookbinding sheet bundle P3 can be obtained through calculation of the number of sheets detected or can be obtained through detection of the thickness. The information on the thickness of the bookbinding sheet bundle P3 can be obtained by providing one or both of the detecting devices.

Further, in this embodiment, the moving speed of the sheet presser 93 is changed according to the number of sheets processed. This is because the mat 94 is stationary. The same effect can be obtained by making the mat 94 vertically movable while making the sheet presser 93 stationary without changing its standby position, and by changing the speed at which the mat 94 moves to the sheet pressing side according to the number of sheets.

While in this embodiment the moving speed of the sheet presser 93 is optimized, the same effect can be obtained in other mechanisms driven in the thickness direction of a bookbinding sheet bundle, etc., such as the face presser unit or the gripper unit, by optimizing the moving speed thereof according to the thickness of the sheet bundle to be processed.

According to the embodiments described above, prior to the operation of pressing the sheet bundle to be cut by the sheet pressing device, control is previously effected so as to reduce the distance between the standby position and the pressing position based on the information on the thickness of the sheet bundle to be cut, detected by the thickness detecting device, whereby it is possible to achieve an enhancement in productivity.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2005-232341, filed Aug. 10, 2005, which is hereby incorporated by reference herein in its entirety.

What is claimed is:

1. A sheet cutting apparatus, comprising:

information obtaining means for obtaining information on a thickness of a sheet bundle to be cut;

a sheet presser movable between a standby position for receiving the sheet bundle and a pressing position for pressing the sheet bundle to fix the sheet bundle;

a cutting knife, which cuts the sheet bundle fixed by the sheet presser; and control means for causing an operation of the sheet presser to be started earlier when the thickness of the sheet bundle is thin than when the thickness of the sheet bundle is thick based on the information obtained by the information obtaining means.

2. A sheet cutting apparatus according to claim 1, wherein the control means controls a moving speed of the sheet presser based on the information obtained by the information obtaining means, and moves the sheet presser from the standby position to another standby position between the standby position and the pressing position at the moving speed.

3. A sheet cutting apparatus according to claim 2, wherein the control means moves the sheet presser from the another standby position to the pressing position at another moving speed which is higher than the moving speed.

4. A sheet cutting apparatus, comprising:

information obtaining means for obtaining information on a thickness of a sheet bundle to be cut;

a sheet presser movable between a standby position for receiving the sheet bundle and a pressing position for pressing the sheet bundle to fix the sheet bundle;

a cutting knife, which cuts the sheet bundle fixed by the sheet presser;

a receiving member, which nips the sheet bundle together with the sheet presser and receives the cutting knife; and control means for causing an operation of the receiving member to be started earlier when the thickness of the sheet bundle is thin than when the thickness of the sheet bundle is thick based on the information obtained by the information obtaining means.

5. A sheet cutting apparatus according to claim 4, wherein the control means controls a moving speed of the receiving member based on the information obtained by the information obtaining means, and moves the receiving member at the moving speed to reduce a distance between the standby position and the pressing position.

6. A sheet processing apparatus, comprising:

a sheet processing portion, which processes a plurality of sheets into a sheet bundle;

conveying means, which conveys the sheet bundle to a predetermined position; and a sheet cutting apparatus according to any one of claims 1, 2, 3, 4, or 5 for cutting the sheet bundle.

7. An image forming apparatus, comprising:

an image forming portion, which forms an image on a sheet; and a sheet processing apparatus according to claim 6 for processing the sheet on which the image has been formed by the image forming portion.

* * * * *